US006937152B2

(12) United States Patent
Small

(10) Patent No.: US 6,937,152 B2
(45) Date of Patent: Aug. 30, 2005

(54) WIRELESS INTERACTIVE DOLL-HOUSES AND PLAYSETS THEREFOR

(75) Inventor: David Small, San Jose, CA (US)

(73) Assignee: Shoot the Moon Products II, LLC, Pleasanton, CA (US)

( * ) Notice: Subject to any disclaimer, the term of this patent is extended or adjusted under 35 U.S.C. 154(b) by 236 days.

(21) Appl. No.: 10/409,925

(22) Filed: Apr. 8, 2003

(65) Prior Publication Data

US 2004/0203317 A1 Oct. 14, 2004

(51) Int. Cl.[7] ..... G08B 13/14

(52) U.S. Cl. ..... 340/568.1; 340/323 R; 340/691.2; 340/691.5; 340/692; 446/297; 446/397; 446/484

(58) Field of Search ..... 340/323 R, 568.1, 340/572.1, 691.1, 691.2, 691.5, 692, 384.7; 250/338.1; 446/397, 408, 484, 297

(56) References Cited

U.S. PATENT DOCUMENTS

| | | | | |
|---|---|---|---|---|
| 311,793 | A | 2/1885 | Stranders | |
| 2,749,663 | A | 6/1956 | Lemelson | |
| 2,918,584 | A | 12/1959 | Edsberg et al. | |
| 3,232,004 | A | 2/1966 | Felsher | |
| 3,880,528 | A | 4/1975 | Peterson et al. | |
| 4,055,761 | A | 10/1977 | Shimomura | |
| 4,125,777 | A | 11/1978 | O'Brien et al. | |
| 4,143,931 | A | 3/1979 | Skare et al. | |
| 4,233,778 | A | 11/1980 | Lemelson | |
| 4,293,768 | A | 10/1981 | Adachi et al. | |
| 4,322,628 | A | 3/1982 | Tanaka | |
| 4,342,173 | A | 8/1982 | Otake | |
| 4,462,066 | A | 7/1984 | Gibson et al. | |
| 4,717,913 | A | 1/1988 | Elger | |
| 4,883,443 | A | 11/1989 | Chase | |
| 4,938,730 | A | 7/1990 | Yamane et al. | |
| 4,941,859 | A | 7/1990 | Zaruba | |
| 4,967,081 | A | 10/1990 | Quad et al. | |
| 5,022,725 | A | 6/1991 | Matsunami et al. | |
| 5,085,609 | A | 2/1992 | Haberle | |
| 5,120,262 | A | 6/1992 | Caine | |
| 5,350,943 | A | 9/1994 | Angerstein et al. | |
| 5,389,578 | A | 2/1995 | Hodson et al. | |
| 5,391,875 | A | 2/1995 | Cederberg et al. | |
| 5,445,552 | A | 8/1995 | Hine | |
| 5,763,900 | A | 6/1998 | Wang | |
| 6,102,397 | A | 8/2000 | Lee et al. | |
| 6,168,494 | B1 | 1/2001 | Engel et al. | |
| 6,206,745 | B1 | 3/2001 | Gabai et al. | |
| 6,227,931 | B1 | 5/2001 | Shackelford | |
| 6,361,396 | B1 * | 3/2002 | Snyder et al. | 446/397 |
| 6,648,719 | B2 * | 11/2003 | Chan | 446/297 |
| 2003/0025504 | A1 * | 2/2003 | Lam | 324/426 |

OTHER PUBLICATIONS

Toys R Us sales ad for the week of Dec. 15–21, 2002, p. 3A, Barbie Dream House.

* cited by examiner

*Primary Examiner*—Thomas Mullen
(74) *Attorney, Agent, or Firm*—Blakely Sokoloff Taylor & Zafman LLP

(57) ABSTRACT

This invention allows for an electronic doll-house to be constructed at a reasonable cost that provides the ability to identify the location of a number of figures that a child may manipulate in a play space. By use of IR communications and the characteristics of such a communications link, a doll-house is provided that combines the ability to be built at a relatively low cost with the advantages of not requiring physical contacts, special purpose RFID chips and transceiving arrangements, or other expensive sensing methods. In brief, the invention makes use of an IR transmitter that sends a unique ID code upon user activation which allows for power savings, the elimination of contact points or RF components, the localization of the signal to a room in a doll-house, and by use of reflecting paths, allows relative independence of orientation. These capabilities are that of a low cost system that allows a system controller to locate an object within a doll-house and consequently allow for an improved location and/or player object specific game play.

44 Claims, 15 Drawing Sheets

100C
112R
114R
112L
114L
203D
203E
203F
203A
203B
203C
402D
402E
402F
402A
402B
402C
202
200
401
404
400
405
400'
206
206'
206''
208
204E
410
114R'
114L'
$\theta_R$
$\theta_T$

| 1306 Waveform | 1302 data | 400 character | 1304 repeat rate |
|---|---|---|---|
| 00000010 | 00000 | unused | n/a |
| 10000010 | 00001 | Dad | 10.0 cycles/sec |
| 01000010 | 00010 | Mom | 7.2 cycles/sec |
| 11000010 | 00011 | Suzy | 4.4 cycles/sec |
| 00100010 | 00100 | Johnny | 3.8 cycles/sec |
| 10100010 | 00101 | Birthday cake | 3.0 cycles/sec |

MSB ⟷ LSB

WIRELESS INTERACTIVE DOLL-HOUSES AND PLAYSETS THEREFOR

FIELD OF THE INVENTION

The invention relates generally to the field of toys. Particularly, the invention relates to doll-houses, dolls and playsets therefor.

BACKGROUND OF THE INVENTION

Doll-houses have a long history and are well known. Historically they have been passive structures into which a user inserts toy furniture and toy doll figures in order to play house. That is, other than a child's imagination, there was no stimulus from a passive doll-house to keep a child with a limited attention span interested in playing house.

Electronics, if any were added to a doll-house, typically were limited to the possible provision of sound effects and electric lighting. The sound effects and electric lighting were typically limited in that they were fixed and did not respond to how a young user or child would play with a doll-house and its characters. For example, a child may move a character from one room to another. A typical electronic toy doll-house would not respond to such a change. Neither the sound effects nor the electric lighting were responsive to changes made by a child or user.

Doll-houses tend to have a complex shape. That is, they tend to have many rooms and many levels or floors. This complexity can make it uneconomical to try and incorporate wired electronics throughout multiple levels and multiple rooms of an electronic doll-house design. Moreover, there is a significant amount of area in a typical sized doll-house in which to mount wired type electronics such as wired switches, wired sensors, electrical connectors, and wired output devices. Additionally, multiple printed circuit boards may need to be used throughout such a wired electronic doll-house. If more than one room is provided, each room may require such wired circuitry increasing the number of electrical components. Using such wired circuitry throughout an electronic doll-house design is costly and deters an electronic doll-house from being sold at an affordable price.

BRIEF DESCRIPTION OF THE DRAWINGS

The features of the invention will become apparent from the following detailed description of the invention in which:

FIGS. 12-1 and 12-2 illustrate an electrical schematic for an embodiment of a wireless interactive doll-house.

FIGS. 16B-1 and 16B-2 illustrate a flow chart diagram of an exemplary room processing routine executed by the doll-house processor.

Like reference numbers and designations in the drawings indicate like elements providing similar functionality.

DETAILED DESCRIPTION OF THE INVENTION

Figure 1:
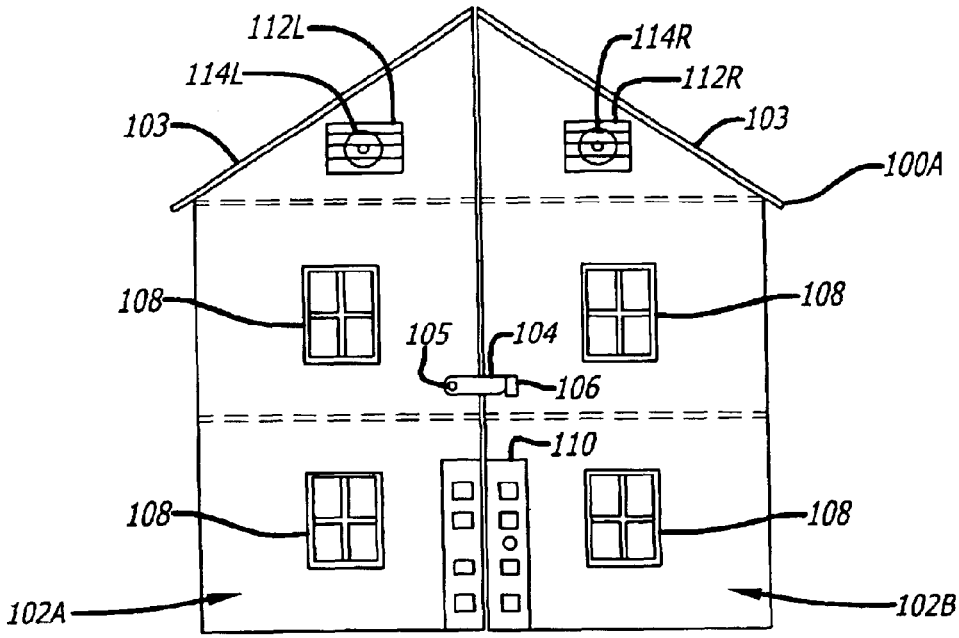
FIG. 1 is a side view of a doll-house incorporating the wireless interactivity of the invention.

In the following detailed description of the invention, numerous specific details are set forth in order to provide a thorough understanding of the invention. However, it will be obvious to one skilled in the art that the invention may be practiced without these specific details. In other instances well known methods, procedures, components, and circuits have not been described in detail so as not to unnecessarily obscure aspects of the invention.

The invention may be practiced in a number of ways. In the preferred embodiment, the wireless interactive doll-house recognizes the individual toy objects and/or characters by receiving an infrared (IR) transmission of an IR light signal. The wireless dolls, toy characters, and/or toy objects transmit an IR signal to be detected by such an IR detector located in the doll-house. This detector may be located in the upper corner of each room of the doll-house. Alternatively, the IR detector may be located outside of the doll-house if its to be centrally located in an open space play area. By proper choice of materials, the wireless dolls, wireless toy characters, and/or wireless toy objects may have the IR emitter (or IR transmitter) in a hidden location inside the body thereof. Some plastics and plastic pigments are opaque to visible light while at the same time are transparent to other non-visible wavelengths of radiant energy, such as infrared (IR) signals. In other cases, plastics and pigments may be opaque to both visible light and other non-visible wavelengths, such as infrared. Opaque means that it exhibits opacity, the ability to block or obstruct the passage of radiant energy. Thus, a wireless doll, toy character, and/or object can be transparent to an IR light signal and have a natural toy look—non-electronic looking—because of the plastics and plastic pigments being opaque or reflective of visible light and transparent to infrared. Furthermore with the IR emitter mounted inside the body of wireless dolls, toy characters, and/or toy objects, no opening is needed in the wireless dolls, toy characters, and/or toy objects that might otherwise collect dirt, liquids or other debris. The wireless interactive doll-house may include one host system including a processor which operates a software program. Thus the wireless interactive doll-house may be programmed such that each IR receiver (or IR sensor) is scanned to detect the proper location (i.e., the specific rooms of the doll-house) of the dolls, toy characters, and toy objects in the doll-house. Knowing the room location of each within the doll-house, allows sound effects, voices and other elements (such as lighting) to be generated in response to each player's specific actions during game playing. The result is in an enhanced interactive experience or game play between a young user and the doll-house.

The present invention provides an improved doll-house that allows a young user or child to experience an enhanced level of interactive game play at a reasonable cost. The present invention incorporates identification devices in each toy character (e.g., a doll) and toy object (e.g., a piece of furniture) and provides wireless connectivity to the doll-house to reduce the amount of wiring and electrical components used therein.

Referring now to FIG. 1, a wireless interactive doll-house 100A incorporating the wireless components of the present invention is illustrated. Doll-house 100A is a clam shell or folding doll house design that includes a first doll-house half 102A and a second doll-house half 102B. Doll-house 100A further includes a toy roof 103, a latch 104, a pivot pin 105, a catch 106, a window 108, and a door 110. The toy roof 103, windows 108, and door 110 are toy equivalents of similar elements commonly found in actual houses. The latch 104, the pivot pin 105, and the catch 106 are for holding the first doll-house half 102A and the second doll-house half 102B of the doll-house 100A in a closed configuration. To generate sounds in response to wireless interactivity, the doll-house 100A includes at least one speaker such as speaker 114L and/or speaker 114R hidden from view by a left speaker grill 112L and a right speaker grill 112R, respectively. To open the doll-house 100A, the latch 104 may be pivoted around the pivot pin 105 and released from the catch 106. In this manner, the first doll-house half 102A and the second doll-house half 102B may be separated at from each other at one end of the doll-house 100A.

Figure 2:
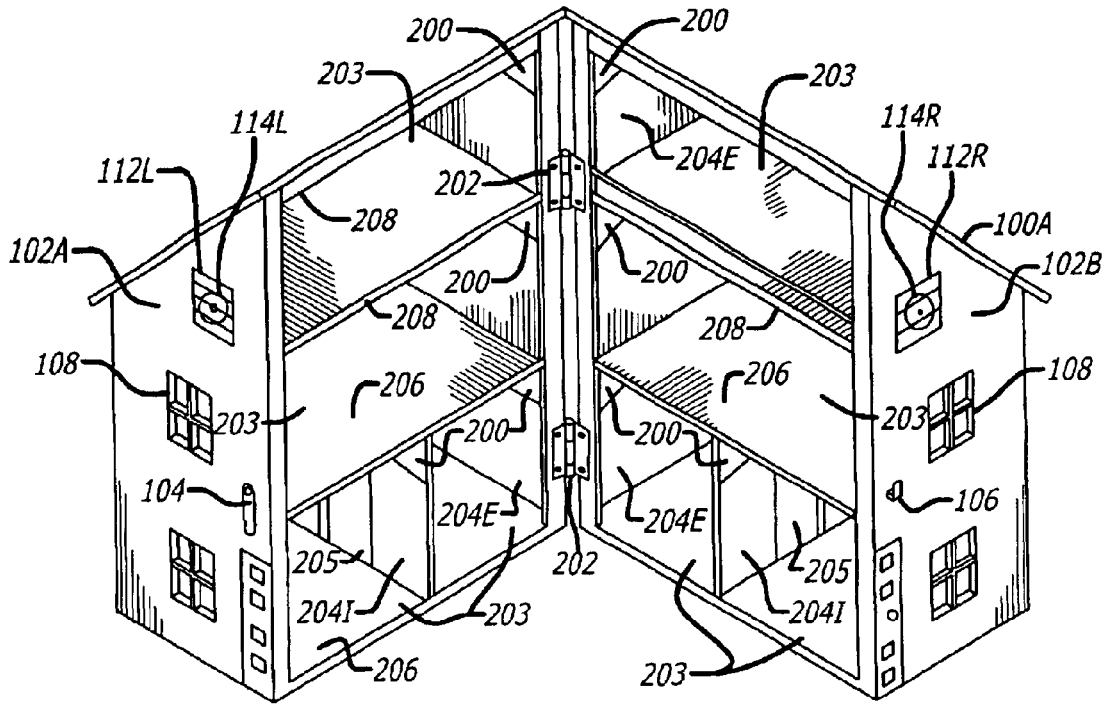
FIG. 2 is perspective view of the doll-house of FIG. 1 illustrating a clam shell design of one embodiment of the invention.

Referring now to FIG. 2, the wireless interactive doll-house 100A incorporating the wireless interactivity of the present invention is illustrated in an open position. To support the wireless interactivity of the present invention, the doll-house 100A includes one or more optical blinders 200 in each floor. At least one optical blinder 200 is found in each room 203 of the doll house 100A. A typical room in a doll house is a scaled room that may model a room in a real house. A doll house room typically has an open face in order to allow a user to move objects, including wireless toy characters, in and out of the room during doll-house play.

To allow the doll-house 100A to open into a first half doll-house 102A and a second doll-house half 102B, one or more hinges 202 are included at one end and a latch 104, pivot pin 105, and a catch 106 at an opposite end. Inside the doll-house 100A are one or more interior walls 204I, one or more exterior walls 204E, one or more interior doors 205, one or more floors 206, and one or more ceilings 208. As will be discussed further below, each optical blinder 200 hides a wireless detector/receiver which is used to detect a wireless transmission from a wireless doll, wireless toy character, or wireless toy object that may be placed in one of the one or more rooms 203 of an wireless interactive doll house.

Figure 3:
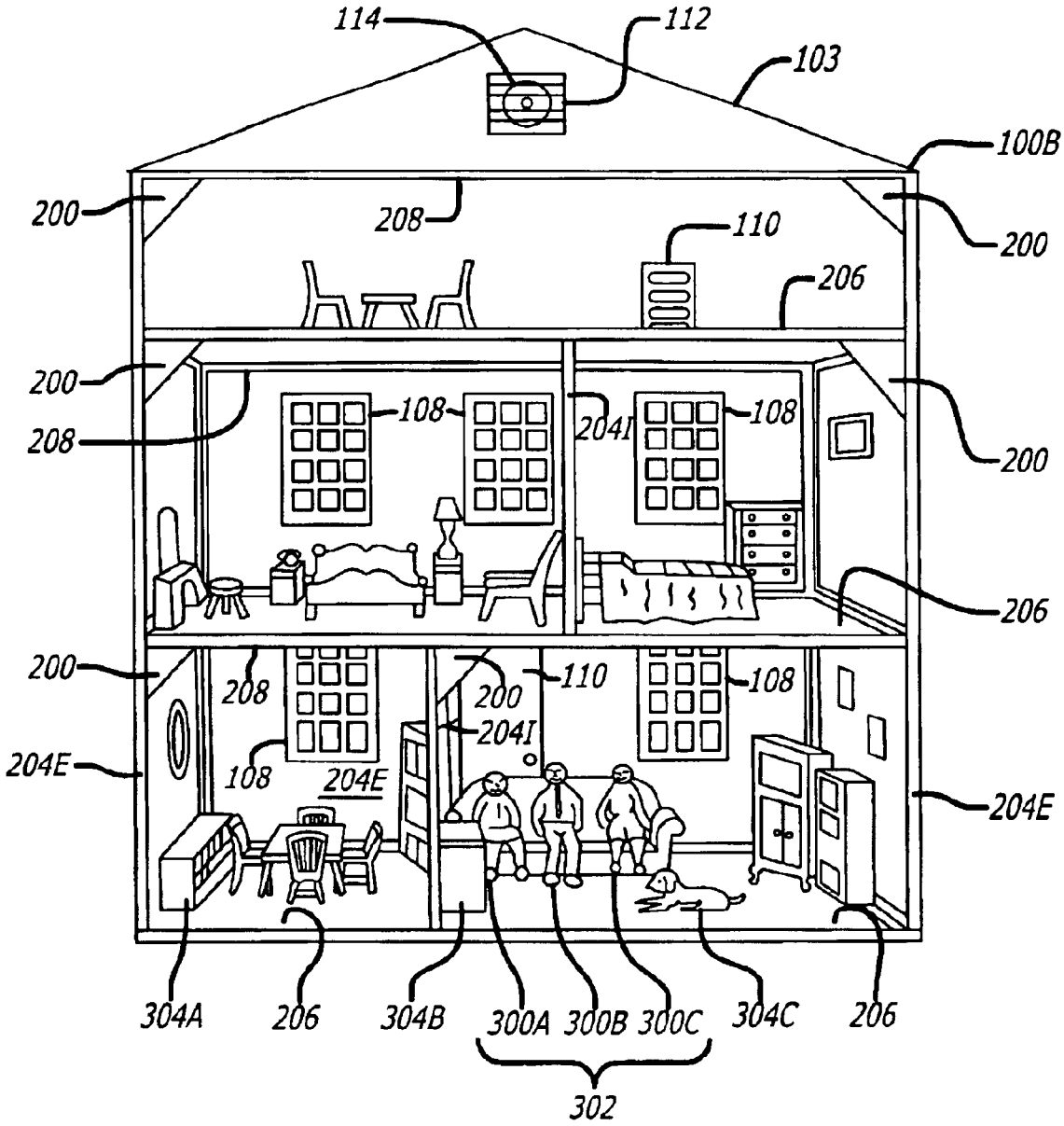
FIG. 3 is a front view of an open design of another embodiment of the invention including exemplary rooms, furniture, and characters that may be used in embodiments of the invention.

Referring now to FIG. 3, a wireless interactive doll-house 100B having an open design and incorporating the wireless components of the present invention is illustrated. The doll-house 100B has a physical layout that includes one or more floors 206, one or more ceilings 208, one or more interior walls 204I, and one or more exterior walls 204E to form one or more rooms 203. The doll-house 100B may further include a roof 103, one or more windows 108, one or more exterior doors 110, and one or more interior doors 205. Placed inside the one or more rooms 203 of the doll-house 100B are toy characters or dolls 300 and objects 304 to form a wireless interactive doll-house system or playset. Exemplary dolls or toy characters 300 may be a family 302 including members such as a mother 300A, a father 300B, and one or more children 300C, such as a daughter (e.g., Suzy) or a son (e.g., Johnny). Exemplary dolls or toy characters may include friends, other family relatives, co-workers or other types of dolls or toy persons. Alternatively and/or in addition to, the doll or toy characters 300 may be toy objects 304 such as a birthday cake, a pieces of furniture 304A, musical instruments, appliances (e.g., television 304B), tools, a family pet (e.g., dog and/or cat 304C), or any other toy object which may be placed within a doll house or other toy structure. The toy objects 304 may or may not wirelessly interact with the doll house in alternate embodiments.

To generate sound effects in response to the wireless interactivity between one or more dolls, toy characters or toy objects and the doll-house, the doll-house 100B includes a speaker 114 near the roofline hidden from view by a speaker grill 112. The sound effects may be a simulated dialogue between two characters in the same room. Alternatively, the sound effects may be sounds or noises that are typically made by the real object such as a television program on a television or a vacuum cleaner motor noise of a vacuum cleaner for example. The doll-house 100B may also include visual lighting effects that are responsive to the wireless interactivity between the toy characters and/or toy objects and the doll-house. For example, the lights may be dimmed in a room when a birthday cake is placed in a room so that lighting on a cake may simulate birthday candles. Alternatively, a wireless toy character may include a flashlight that turns on to light a room in response to a simulated time of day (e.g., night time). Exterior and interior lighting may be provided responsive to a simulated time of day (e.g., night time). Alternatively, the doll house may instead be a fire station and the visual effects may be a red flashing light to indicate a fire and that the firemen need to leave the fire station to attend the fire, for example.

To provide the wireless interactivity, the toy characters 300 and objects 304 include a wireless transmitter to transmit a signal to the one or more wireless receivers in the doll house 100B. In the case of IR wireless signals, each room may include a wireless receiver hidden by an optical blinder 200. In this case, the roof 103, the one or more windows 108, the one or more exterior doors 110, the one or more interior doors 205, the one or more floors 206, the one or more ceilings 208, the one or more interior walls 204I, and the one or more exterior walls 204E forming the one or more rooms 203 may be made opaque (i.e., not transparent) to IR wireless light signals so that each room can be scanned separately. The optical blinder 200 in each room may be made opaque (i.e., not transparent) to IR wireless light signals to limit a wireless receiving area to a room inside the doll house and exclude areas outside.

When the toy characters 300 and/or objects 304 are moved from outside the doll-house 100B into a room inside the doll-house 100B, or are moved from room to room within the doll-house, they wirelessly interact with the doll-house 100B. This wireless interaction typically causes the doll house to generate a response thereto referred to as a programmed response. The programmed response may be a visual effect (e.g., light fixture turning on and off), a sound effect (e.g., a radio station playing when a radio is moved into a room, or a scripted conversation or dialogue between characters takes place), or a motion effect (e.g., a fan starts turning to cool a room).

Figures 4, 6, 7:
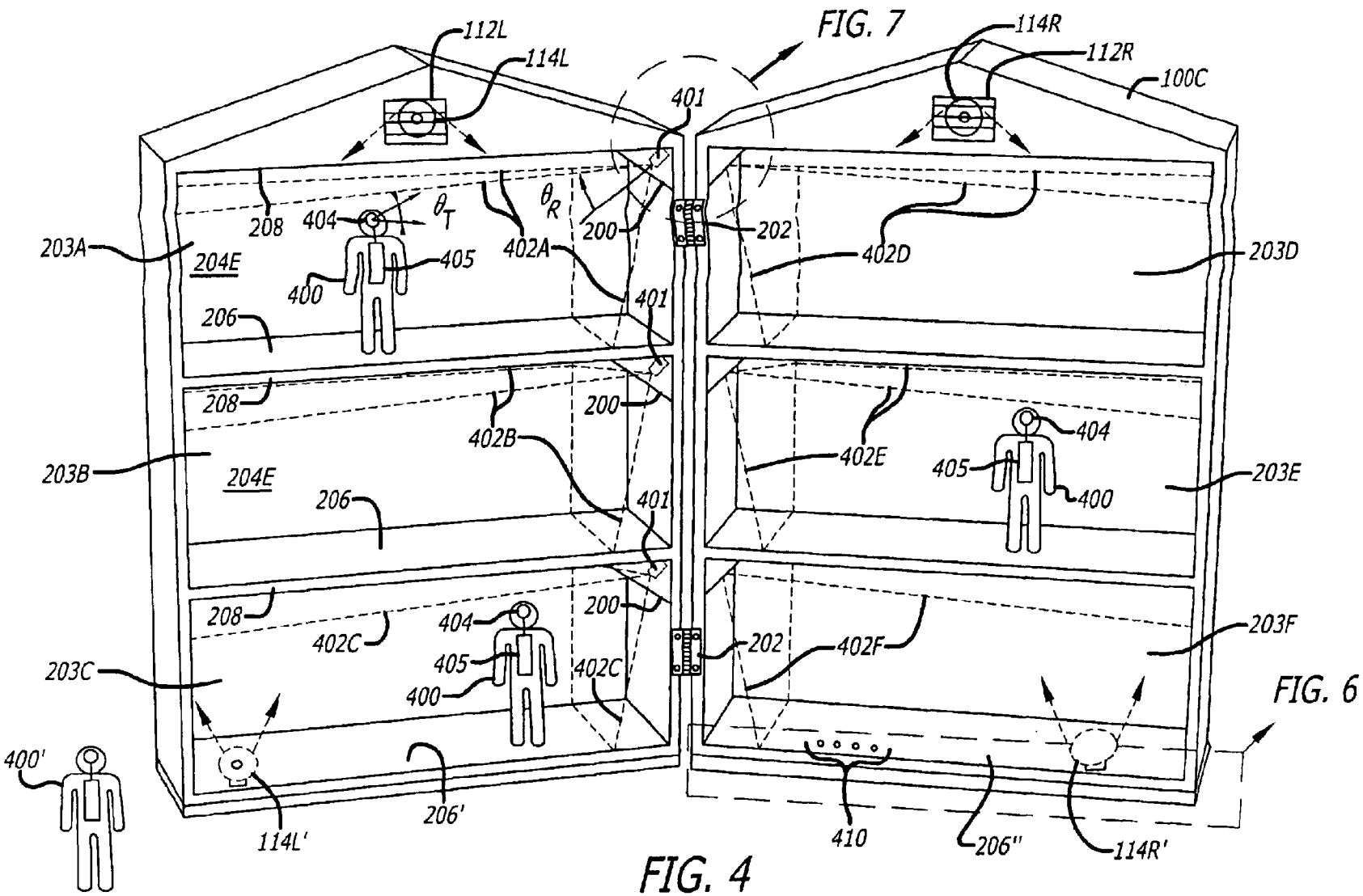
FIG. 4 is a perspective view illustrating the wireless interactivity between toy characters/objects and the wireless interactive doll-house.
FIG. 6 is a magnified cross sectional view of a portion of FIG. 4.
FIG. 7 is a magnified perspective view of another portion of FIG. 4.

Referring now to FIG. 4, a wireless interactive doll-house 100C is illustrated with one or more toy characters or toy objects 400 including a wireless transmitter to form an exemplary wireless interactive doll house system. In FIG. 4, the toy characters 300 and toy objects 304 previously described with respect to FIG. 3 are collectively referred to here as wireless toy characters 400. The wireless interactive doll house 100C is divided up into a plurality of rooms 203A–203F. Hidden behind the optical blinders 200 in each room 203A–203F (generally referred to as room or rooms 203), are a wireless receiver 401. In the embodiment of the doll house 100C of FIG. 4, the IR sensors 401 are located in the top corner of each room 203. In alternate embodiments, the IR sensors 401 may be located in different positions in the room such as a floor or as part of a room fixture. Each of the wireless toy characters 400 includes a wireless transmitter 404 to transmit a wireless signal to a wireless receiver 401. As discussed previously and further below, in the preferred embodiment the wireless transmitter 404 is an infrared transmitter and the wireless receiver 401 is a infrared receiver. Each wireless toy character 400 further includes transmit electronics 405. The doll-house 100C includes one or more interior walls 204I, one or more exterior walls 204E one or more floors 206, and one or more ceilings 208, and may include other elements of a doll house.

As previously discussed, the roof 103, the one or more windows 108, the one or more exterior doors 110, the one or more interior doors 205, the one or more floors 206, the one or more ceilings 208, the one or more interior walls 204I, and the one or more exterior walls 204E forming the one or more rooms 203 of the doll house may be made opaque (i.e., not transparent) to IR wireless light signals so that each room 203A–203F may be scanned separately. With IR sensors located within the body of a room 203, they are shielded from the emissions generated in any of the other rooms that may have wireless toy characters or toy objects in them. The optical blinder 200 in each room may be made opaque (i.e., not transparent) to IR wireless light signals to limit a wireless receiving area to a room inside the doll house and exclude areas outside. The optical blinders can be used around the IR detectors 401 to block viewing of areas that are not of interest, such as any IR signal radiating from outside the doll house and the outside environment. Optical blinding of the IR sensors 401 may be used to prevent reflections from people or objects outside of the doll house from being seen by the sensors. Thus, each of the wireless receivers 401 and optical blinders 200 in each room 203A–203F establishes a receiver boundary 402A–402E. In the embodiment of the doll-house 100C, each of the optical blinders 200 establishes a reception angle $\theta_R$ ("theta R") for each of the wireless receivers 401 and a reception area 403A–403E (generally referred to as "reception area 403") for the respective receiver boundary 402A–402E (generally referred to as "receiver boundary 402").

As previously discussed, each of the wireless toy characters 400 includes a wireless transmitter 404 to transmit a wireless signal to a wireless receiver 401. Each wireless transmitter 404 establishes an emission or transmission angle $\theta_T$ ("theta T") of the wireless toy character 400. By the use of a wide emission angle light emitting diode (LED) in the wireless doll, wireless toy character or wireless toy object, such as a plus or minus (+/−) seventy degrees for $\theta_T$, and a wide reception angle IR receiver in the doll house in combination with any optical blinding, such as plus or minus (+/−) fifty degrees for $\theta_R$, when combined with the ability of IR light to bounce within the confines of a room, can insure that a wireless doll, wireless toy character, or wireless toy object in a room may be detected by the wireless receiver, detector or sensor 401. In contrast a wireless toy character outside of a reception area 403 defined by the receiver boundary 402, such as wireless toy character 400' in FIG. 4, would not be detected by the wireless receiver, detector, or sensor 401.

Doll-house 100C additionally includes the one or more hinges 202 between the first doll-house half 102A and the second doll-house half 102B of the doll-house 100C. The left speaker 112L and/or right speaker 112R may be hidden from view by a speaker grill 114L and speaker grill 114R, respectively. Otherwise, the speakers may be hidden from view under the flooring 206. In which case, the doll-house 100C may include a left speaker 114L' in a floor 206' and/or a right speaker 114R' in a floor 206". With both left and right speakers, stereo sound effects may be generated by the doll house.

In FIG. 4, the doll-house 100C further includes, as may other embodiments, one or more switches 410 to control the interactivity between the doll-house 100C and the one or more wireless toy characters 400. The one or more switches 410 may be part of a printed circuit board located under the floor 206" and hidden from view. The printed circuit board includes electronic circuitry (referred to as "doll house electronics") to monitor each of the IR detectors 401 located in each room 203. As discussed previously, the doll house electronics may include a processor (i.e., a microcontroller) executing a software program (referred to as the "doll house software"). If a valid signal is detected by the doll house electronics, the doll house software processes the signal and takes whatever action is specified by the programming of the microcontroller. Specific locations of the wireless toy characters 400 within the wireless interactive doll house may automatically generate an audio script of sound effects which is to be played by the doll house through the speakers. For example, if the toy characters representing mother and daughter are both located in a doll house room such as a toy kitchen, the doll house may play one of a number of scripts specific to mother and daughter being in the kitchen together. Alternatively the doll house can be manually commanded to play a script based on the locations of the dolls in the wireless interactive doll house by a user pressing one of the switches 410, such as a play button or switch.

Figure 5B:
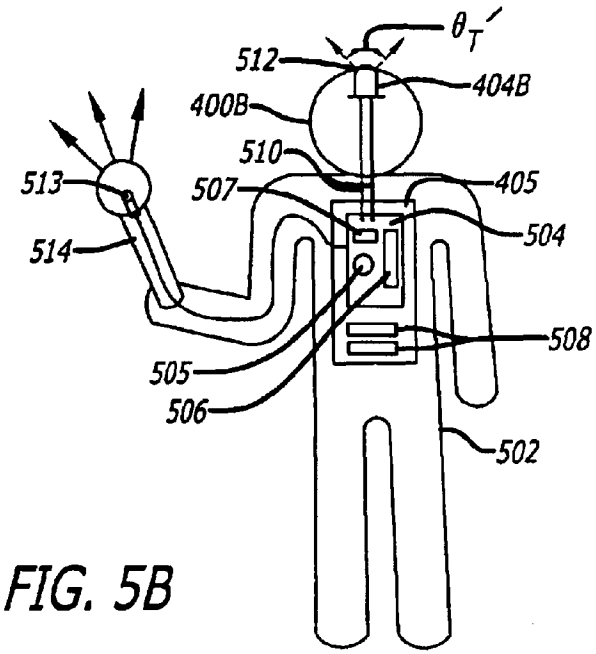
FIG. 5B is a cutaway view of another embodiment of a toy character/object with a wireless transmitter positioned different from that of FIG. 5A.
Figure 5A:
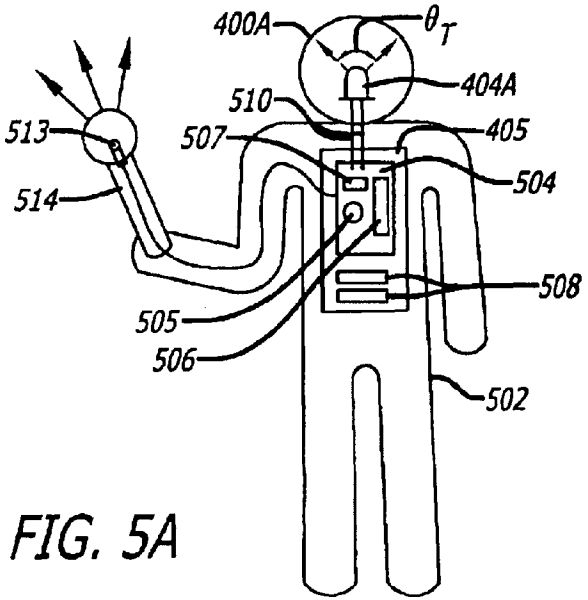
FIG. 5A is a cutaway view of an embodiment of a toy character/object with a wireless transmitter.
Figure 6:
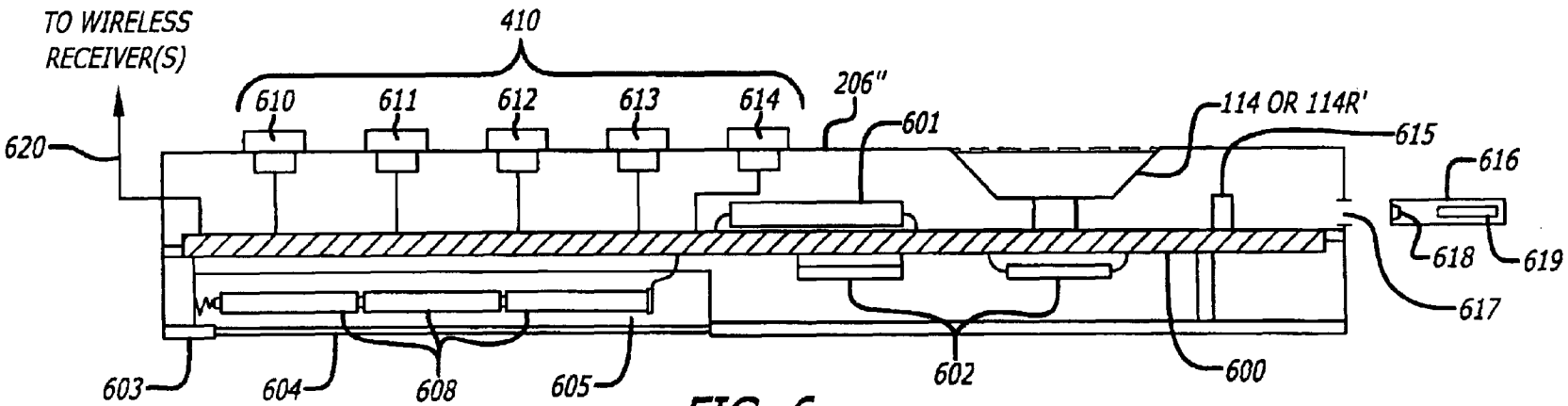
Figure 7:
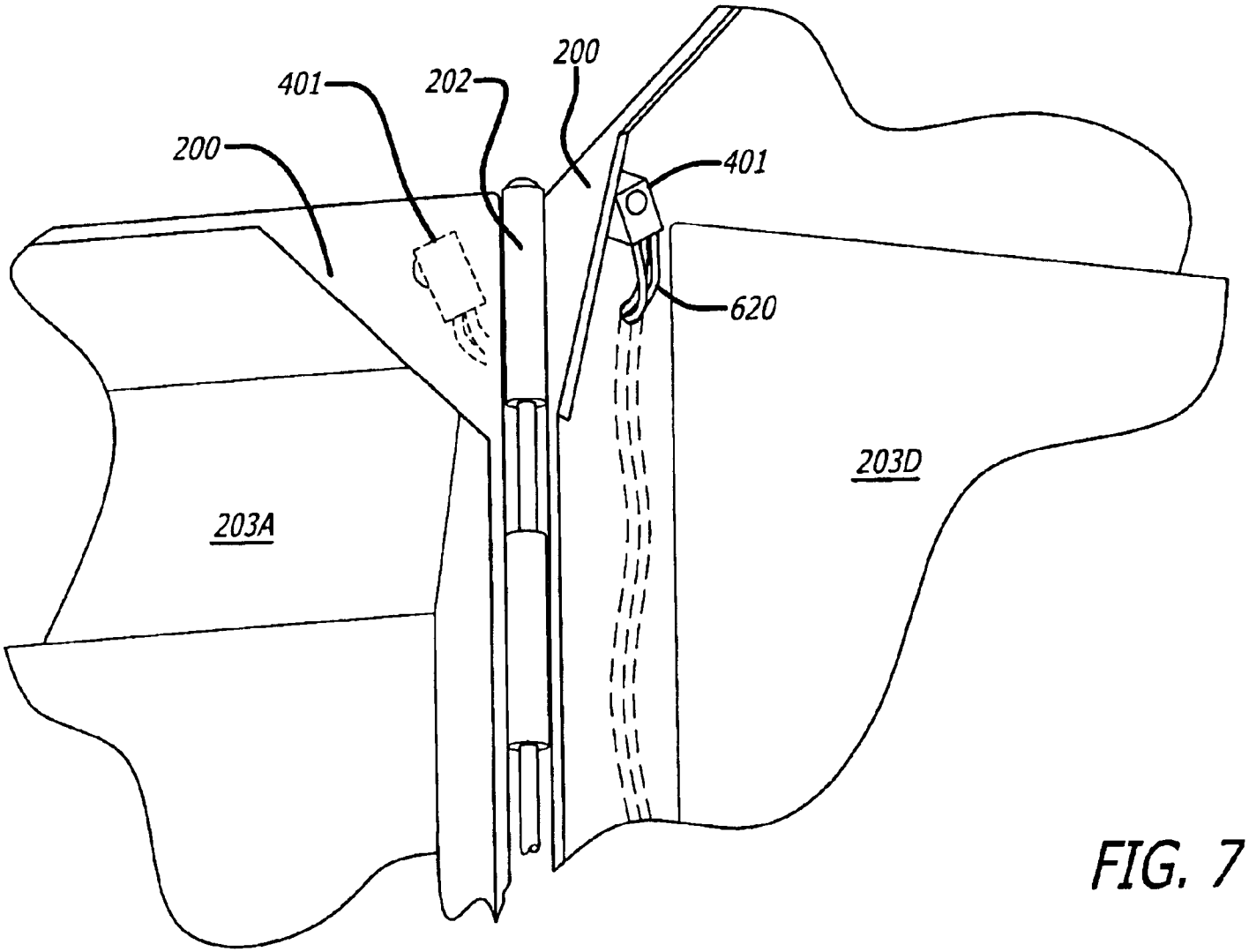

Referring now to FIGS. 5A–5B, cutaway views of embodiments a wireless toy character 400A–400B are illustrated. FIGS. 5A–5B illustrate an exemplary physical arrangement of components within a wireless toy character 400. The wireless toy character 400A–400B has an opaque body, housing or shell 502 that may reflect visible light. The opaque body, housing or shell 502 may be shaped as a toy character such as a mother, father, sister, brother, man, woman, or child. Alternatively, the opaque body, housing or shell 502 may be shaped as an object such as a dog, furniture, pie, cake, or some other type of object.

The wireless toy character 400A further includes an internal infrared (IR) light emitting diode (LED) 404A and the transmit electronic assembly 405 which may be inside and hidden from view by the opaque body, housing, or shell 502. As discussed previously, the opaque body, housing, or shell 502 is transparent to the wavelength or frequency of the wireless signal and opaque to visible light in one embodiment. The wireless transmitter 404A is mounted internal to wireless toy character 404A and has an emission angle of $\theta_T$. The type of wireless transmitter 404A may be selected to provide a desired angle of emission $\theta_T$. In one embodiment, the wireless transmitter 404A is an infrared light emitting diode (LED) and has a wide emission angle of $\theta_T$, such as plus or minus (+/−) seventy degrees. In another embodiment, the body, housing, or shell 502 may not be transparent to the wireless signal, but instead have an opening and the wireless transmitter may be configured therein so that the wireless signal need not pass through a body, housing, or shell 502 but through the opening.

Referring to FIG. 5B, the wireless transmitter 404B is mounted in the wireless toy character 400B different from wireless transmitter 404A mounting in wireless toy character 400A of FIG. 5A. Other elements of the wireless toy character 400B using similar reference numbers are similar to the wireless toy character 400A of FIG. 5A. The wireless transmitter 404B is mounted so that an emission end is near an opening 512 in the body, housing, or shell 502 of the wireless toy character 400B. The wireless transmitter 404B has an emission angle of $\theta_T'$ through the opening 512. The size of the opening 512 and the type of wireless transmitter 404B may be selected to provide a desired angle of emission $\theta_T'$. The type of wireless transmitter 404A may be selected to provide a desired angle of emission $\theta_T$.

The transmit electronic assembly 405 in each of the wireless toy characters 400, includes a printed circuit board 504, a push button switch 505 and/or a jiggle switch 506, transmit electronics 507, and one or more batteries 508. The IR LED 404A may be directly coupled to the printed circuit board 504 or indirectly coupled to the PCB 504 (i.e., electrically coupled) by one or more wires 510 as shown. A wireless toy character 400 may further include one or more light bulbs or light emitting diodes 513 that emit at visible wavelengths to add a lighting effect to the toy character 400 such as a flashlight 514 within a dark room, for example. In another case, the one or more light emitting diodes 513 that emit at visible wavelengths may be used to simulate birthday candles of a birthday cake.

In one embodiment, the wireless toy characters 400 may be configured to wirelessly transmit and emit an identification (ID) signal repetitively in a continuous manner after being powered on by a power switch. However, this approach does not conserve power. In another embodiment, the wireless transmission and emission of an identification (ID) signal is triggered and not continuously emitted until the power is turned off. The wireless transmission may be triggered by a motion of the wireless toy character or object 400 or by the user pressing a button which is included as a part of the wireless toy character 400. This approach allows for more control by the player and for the conservation of battery power since the wireless ID emission need only be transmitted one or more times over a fixed period of time after the trigger and not repeatedly transmitted in a continuous approach while power is supplied to the wireless toy character 400. In FIG. 5A, the wireless toy character 400A may include a button switch 505 and/or a jiggle switch 506. The jiggle switch 506 implements the triggering of the wireless transmission and emission of an identification (ID) signal by a motion of the wireless toy character or object 400A. The button switch 505 implements the triggering of the wireless transmission and emission of an identification (ID) signal by the user pressing a button. The pressing of the button for the control of the characters or objects can be a function of the game play or activity of a user.

As discussed previously, each wireless toy character or object 400 emits an identification (ID) signal so that it can be sensed by a wireless receiver which is apart of the doll house 100. In the preferred embodiment, the ID signal is repeated one or more times over a fixed period of time upon the triggering event (e.g., movement or pushed button). The emitted ID signal includes a data packet including a field or ID code that identifies the toy character or object 400 to the doll house 100. The ID code embedded in the data packet may be unique so that each wireless toy character or object 400 can be uniquely identified in one embodiment. In another embodiment, the same or another ID code may be common to more than one wireless toy character 400 to connote a common characteristic among them. The repetitive transmission of the data packet with the ID code may be chosen so that (1) the ID signal is repeated a sufficient number of times so that it will be received and the wireless toy character 400 identified during a scan of the various rooms in the doll house 100 by the controller; and (2) the rate of repetition of the ID signal is different across wireless toy characters or objects 400 to further distinguish from each. With differing repetition rates of the ID signal, even if two buttons on two wireless toy characters 400 are pressed by a user at the same time to trigger the ID signal emission, the differing repetition rates will insure that a clear, non overlapped transmission will be sent by each within a room.

Figures 13, 16A:
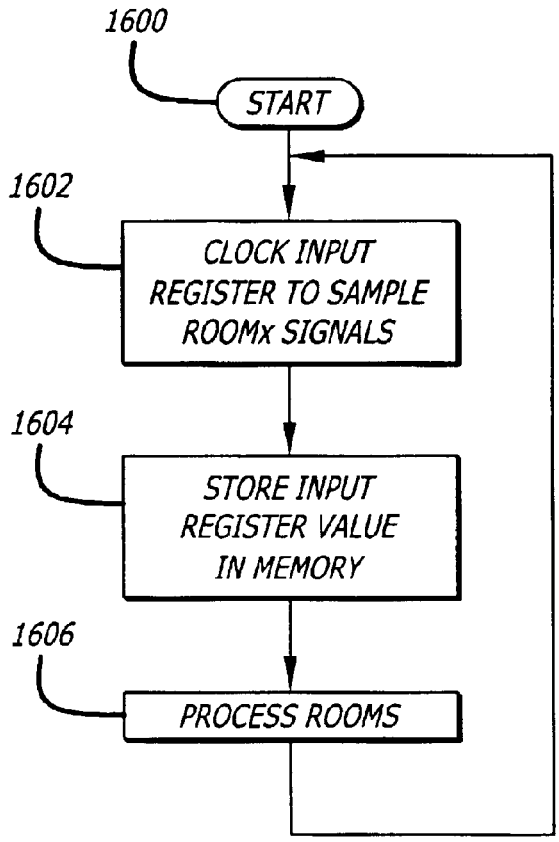
FIG. 13 illustrates a table of exemplary character identification values and exemplary repetition rates for exemplary toy characters/objects.
FIG. 16A illustrates a flow chart diagram of an exemplary room scanning routine executed by the doll-house processor.

Referring momentarily to FIG. 13, an exemplary table of ID data packets 1302 and repetition rates 1304 for different wireless toy characters 400. The repetition rates 1304 differ from each wireless toy character 400 as does the ID data packet 1302. For example consider the wireless toy character 400 as a birthday cake, the ID data packet is 00101 which is repeated over a fixed period of time at the rate of three cycles per second (3.0 cycles/sec.). Additional data fields may be added so that further information may be transmitted about each of the wireless toy characters 400.

Referring now to FIG. 6, a magnified cross sectional view of a portion of FIG. 4 illustrates the location of doll house electronics associated with the wireless interactive doll house 100C. The doll house electronics of the doll house 100C is located under the floor 206". The doll house electronics includes a printed circuit board 600 having a controller 601. The printed circuit board 600 may be referred to herein as a doll house printed circuit board. The controller 601 may be a microprocessor or microcomputer which may include a programmable memory to store control or program code for operation of the wireless interactive doll house 100C. Furthermore, the printed circuit board 600 may include other circuits 602 such as an external memory, digital logic, analog amplifiers, transistors, resistors, capacitors, and/or inductors for operation of the wireless interactive doll house 100C. A base 603 of the doll house 100C may include a battery door 604 that opens to obtain access to a battery compartment 605 of the doll house 100C and one or more batteries 608 therein. Otherwise, the doll house 100C may be provided with a power supply converter that plugs into a wall plug and an alternating current power supply which is provided by the power companies, such as 110v AC in the United States, in order to provide a DC power supply to the electronic components of the doll house printed circuit board 600. The base may further provide supports and extrusions that support and hold the printed circuit board 600 in place within the doll house 100C. The doll house electronics further includes the one or more switches 410. The one or more switches 410 may include an ON/OFF power switch 610, a mode switch 611, a speak switch 612, and a volume switch 613. The speak switch 612 when manually selected commands the doll house to generate the programmed response in response to the location of the wireless toy characters therein. The mode switch 611 toggles the doll-house between operating in an automatic mode and a manual mode. In automatic mode, the programmed response is automatically generated (e.g., scripts of dialogue are automatically played through the speaker) based on location of the dolls within the doll house. In a manual mode, a user has to press the speak switch 612 in order for the doll house to generate the programmed response. The doll house electronics may further include the speaker 114 or right speaker 114R' coupled to the printed circuit board 600. Alternatively, a wire or cable may be used to electrically couple the printed circuit board 600 to a remote speaker 114 or pair of speakers 114L and 114R as illustrated in FIG. 4. In any case, the doll house electronics generate the programmed response such as sound signals which are coupled to the speaker(s) 114 for sound effects which are responsive to the interaction between the wireless toy characters 400 and the doll house 100C.

In FIG. 6, one or more wires or cables 620 couple between the doll house printed circuit board 600 and the one or more wireless receivers 401 of the doll house to connect them together. In a preferred embodiment, the one or more wires or cables 620 are electrical wires or cables strung along the one or more hinges 202 between the halves 102A and 102B to electrically connect the doll house printed circuit board 600 and the one or more wireless receivers 401 of the doll house together. In another embodiment, the one or more wires or cables 620 may be hidden from view behind a hollow wall and routed between the doll house printed circuit board 600 and the one or more wireless receivers 401 in each room of each floor. In yet another embodiment, the one or more wires or cables 620 are fiber optic cables or light pipes to direct the wireless transmission from each room to a wireless receiver mounted on the printed circuit board 600. In yet another embodiment, the wireless receivers 401 may each be self powered and include an RF wireless transmitter to transmit the information to a wireless receiver mounted to the printed circuit board 600. The wireless transmitter and receiver may be designed to operate using the Bluetooth specification, for example.

To expand the functionality of the doll house 100C and/or to update/change the program code for the controller 601, the doll house printed circuit board 600 may include a connector 615 which receives a connection of an external memory card 616. The external memory card 616 may be received by the doll house 100C through a slot 617 in an external wall or base of the doll house. The external memory card 616 includes the connection 618 and a memory device 619. The memory device 619 may have expansion code of new scripts of sound effects associated with newly introduced wireless toy characters 400. Alternatively, the memory device 619 may have update code that updates the functionality of the existing doll house and wireless toy characters 400 or repairs bugs in the prior code.

Referring now to FIG. 7, a magnified perspective view of a portion of FIG. 4 illustrates the wireless receivers 401 located behind the optical blinders 200 in greater detail. In this embodiment, the optical blinder 200 is at a corner of each room and forms the wireless receiver boundary 402 and to establish the reception area 403 of the respective room 203. The optical blinder 200 may also be referred to herein as a corner optical blinder. The one or more wires or cables 620 couple between the doll house printed circuit board 600 and the one or more wireless receivers 401. In one embodiment, an electrical couple is established by the one or more wires or cables 620. The one or more hinges 202 hold the first half and the second half of the doll house 100C rotatably coupled together. The one or more wires or cables 620 can route along the inside portion of the wall or along the one or more hinges 202 of the doll house 100C.

Figure 8:
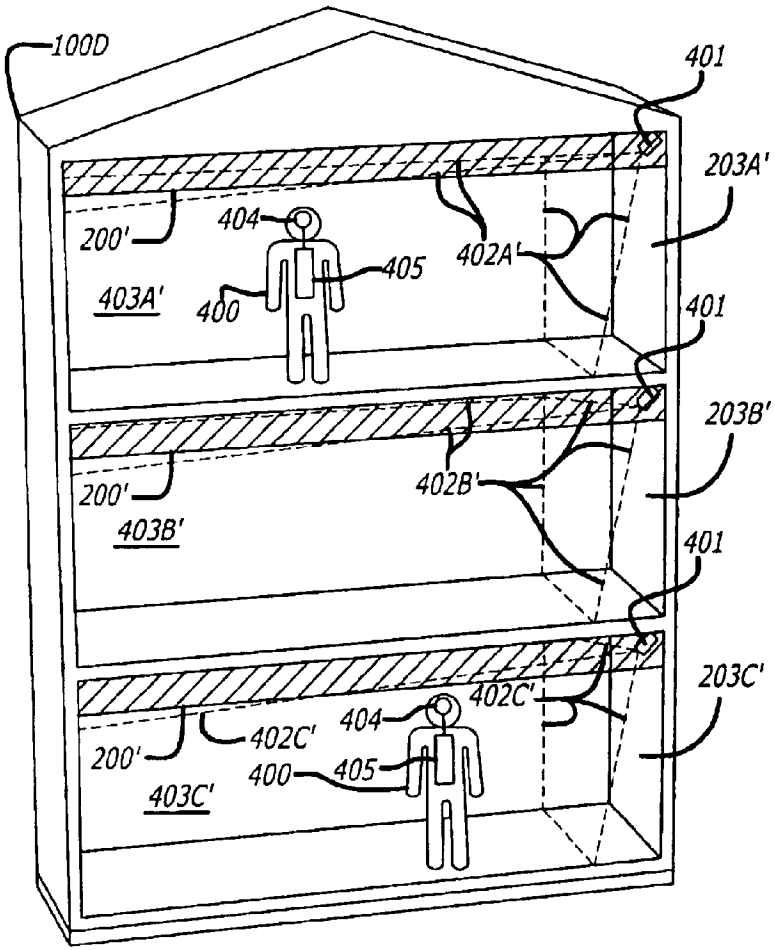
FIG. 8 illustrates another embodiment of the invention.

Referring now to FIG. 8, an interactive wireless doll house 100D is illustrated as another embodiment of the invention. Instead of the corner optical blinders 200 of FIG. 4, the interactive wireless doll house 100D has optical blinders 200' of a different shape or dimensions that extend over the length of a room. The optical blinders 200' may be an extrusion from the ceiling at the edge of the room that has the appearance of a valance or a raised curtain. The optical blinders 200' may also be referred to herein as valance optical blinders 200'. The valance optical blinders 200' conceal the wireless receivers 401 from view. The valance optical blinders 200' are also opaque to the wireless signal frequency and wavelength to form the receiver boundaries 402A', 402B', and 402C'; reception angles; and reception areas 403A', 403B', and 403C' in rooms 203A', 203B' and 203C', respectively. In alternate embodiments, the type of optical blinders used in an interactive wireless doll house may be mixed. For example, corner optical blinders 200 may be used in some rooms of a doll house while the valance optical blinders 200' may be used other rooms.

Figure 9:
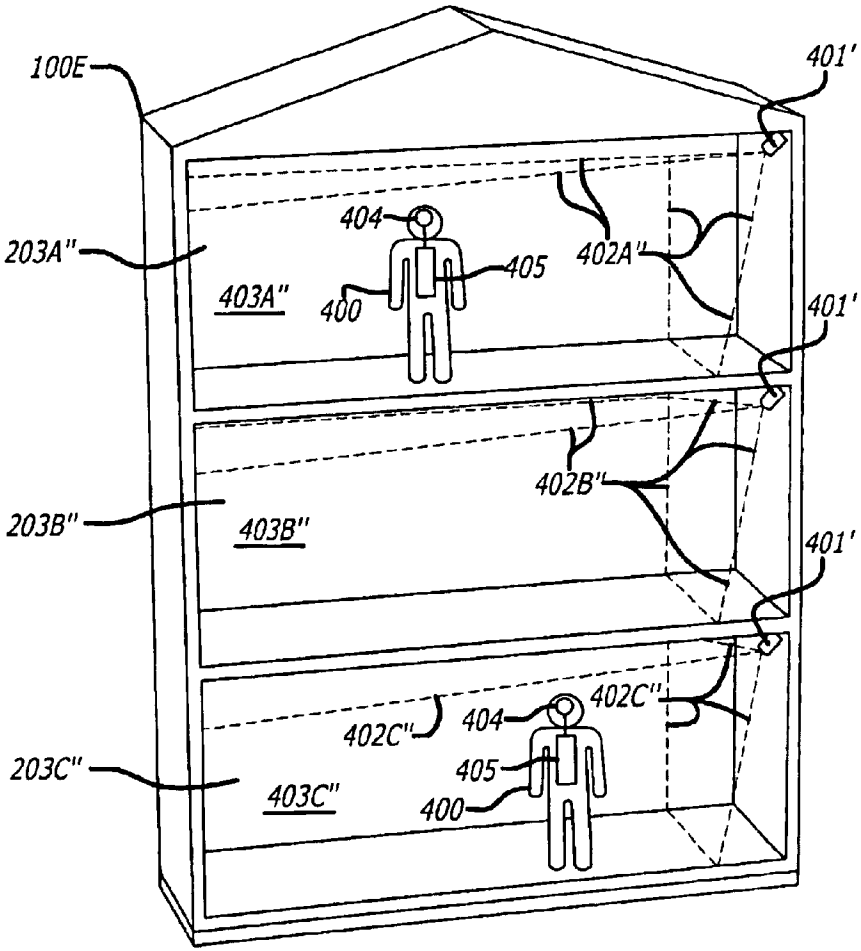
FIG. 9 illustrates another embodiment of the invention.

Referring now to FIG. 9, an interactive wireless doll house 100E is illustrated as another embodiment of the invention. Instead of the corner optical blinders 200 of FIG. 4 or the valance optical blinders 200' of FIG. 8, the interactive wireless doll house 100E incorporates wireless receivers 401' with blinders. The blinders are part of the optical elements of the wireless receivers 401'. The wireless receivers 401' form the receiver boundaries 402A", 402B", and 402C"; reception angles; and reception areas 403A", 403B", and 403C" in rooms 203A", 203B" and 203C", respectively. In order to do so, the wireless receivers 401' include integrated optical blinders.

Figure 10C:
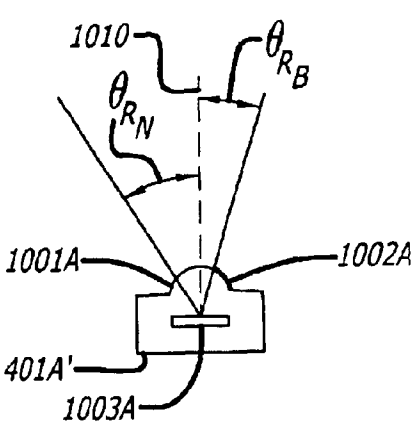
FIG. 10C is a top view of the wireless receiver illustrated in FIG. 10A.
Figure 10B:
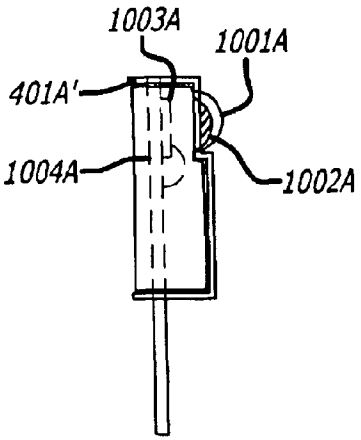
FIG. 10B is a side view of the wireless receiver illustrated in FIG. 10A.
Figure 10A:
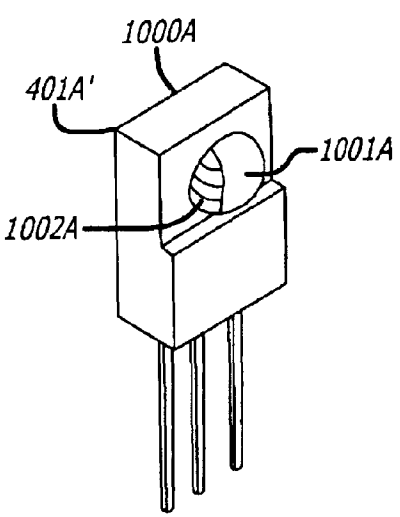
FIG. 10A illustrates a perspective view of an embodiment of a wireless receiver with an integrated optical blinder for use with the embodiment of the interactive wireless doll-house of FIG. 9.

Referring now to FIGS. 10A–10C, an embodiment of a wireless receiver 401A' for use as the wireless receivers 401' of the doll house 100E with the integrated optical blinders is illustrated. The wireless receiver 401A' includes a housing or body 1000A, a lens 1001A, and an optical blinder 1002A. The optical blinder 1002A is integrated into the wireless receiver so that the corner optical blinders or valance optical blinders need not be used in rooms of the doll house. As with the wireless receivers 401, the mounting angle in the room is also important to properly form the receiver boundaries 402 and the reception areas 403 in each room 203. The optical blinder 1002A is opaque to the wireless signal frequency or wavelength so that a signal is received over a reduced area and angle. The optical blinder 1002A alters the normal reception angle theta R ("$\theta_R$") over a certain portion of a normal reception cone area. In the doll house, it is the portion nearest the open face of the doll house that is preferably altered by the optical blinder.

In FIG. 10B, an infrared light emitting diode 1003A is mounted behind the lens 1002A to a header 1004A. The lens 1002A is a semi-spherical lens having a round shape. The optical blinder 1002A covers over portion of the lens 1002A to alter the reception angle, theta R. Because the lens 1002A is semi-spherical and has a round shape, the optical blinder 1002A attached to a portion thereof is a sliver of the semi-sphere or arc shaped.

Referring now to FIG. 10C, the optical blinder 1002A alters a normal reception angle $\theta_{RN}$ ("theta sub RN") with respect to a normal optical axis 1010 with the emitter 1003A. The optical blinder 1002A alters the normal reception angle $\theta_{RN}$ to a blinder reception angle $\theta_{RB}$ ("theta sub RB") on one side. The normal reception angle, $\theta_{RN}$, is greater than the blinder reception angle, $\theta_{RB}$. The blinder reception angle, $\theta_{RB}$, moves a reception boundary in towards the normal 1010 and reduces the reception area so that it encompasses a room of the doll house and avoids receiving signals in an area outside the doll house. This allows the interactive wireless doll house to be designed without the corner or valance type of optical blinders 200 and 200' in each room.

Figure 10D:
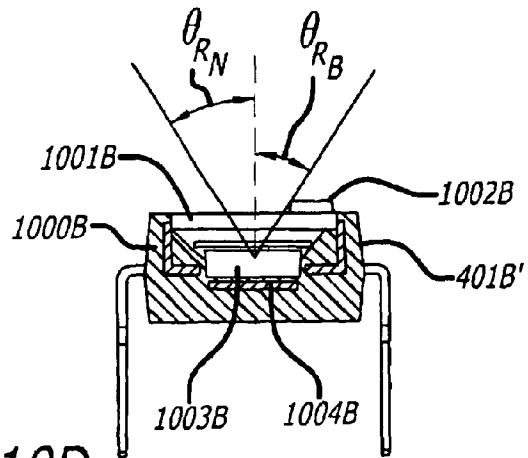
FIG. 10D is a cross sectional side view of another embodiment of a wireless receiver with integrated optical blinder for use with the embodiment of the interactive wireless doll-house of FIG. 9.

Referring now to FIG. 10D, a wireless receiver 401B' is illustrated including an integrated optical blinder. The wireless receiver 401B' includes a shell or housing 100B, a lens 1001B, an optical blinder 1002B, and an emitter device 1003B coupled to a header 1004B. Lens 1001B is a flat lens. The optical blinder 1002B is flat as well and covers over a portion of the flat lens. The optical blinder 1002B is opaque to the wireless signal frequency or wavelength so that a signal is received over a reduced area and angle. The optical blinder 1002A alters a normal reception angle $\theta_{RN}$ ("theta sub RN") with respect to a normal optical axis 1010 with the emitter 1003B. The optical blinder 1002B alters the normal reception angle $\theta_{RN}$ to a blinder reception angle $\theta_{RB}$ ("theta sub RB") on one side. The normal reception angle, $\theta_{RN}$, is greater than the blinder reception angle, $\theta_{RB}$. The blinder reception angle, $\theta_{RB}$, moves a reception boundary in towards the normal 1010 and reduces the reception area so that it encompasses a room of the doll house and avoids receiving signals in an area outside the doll house.

Figure 10E:
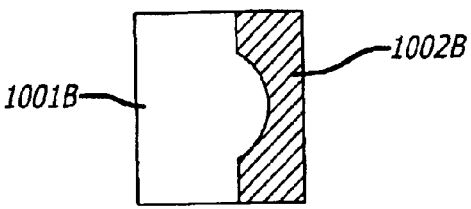
FIG. 10E is a top view of the lens with integrated optical blinder of the wireless receiver illustrated in FIG. 10D.

Referring now to FIG. 10E, an exemplary portion of the lens 1001B is covered by the optical blinder 1002B so that the blinder reception angle, $\theta_{RB}$, is reduced from that of the normal reception angle, $\theta_{RN}$. More or less of the lens 1001B is covered to alter the blinder reception angle, $\theta_{RB}$, and reduce the reception boundary 402 and the reception area 403 of a room 203. While a flat lens and a round or semi-spherical lens have been shown and discussed to include the optical blinder, other types of lenses may have an optical blinder coupled thereto in order to similarly reduce the reception angle, reception boundary and reception area.

Figure 11A:
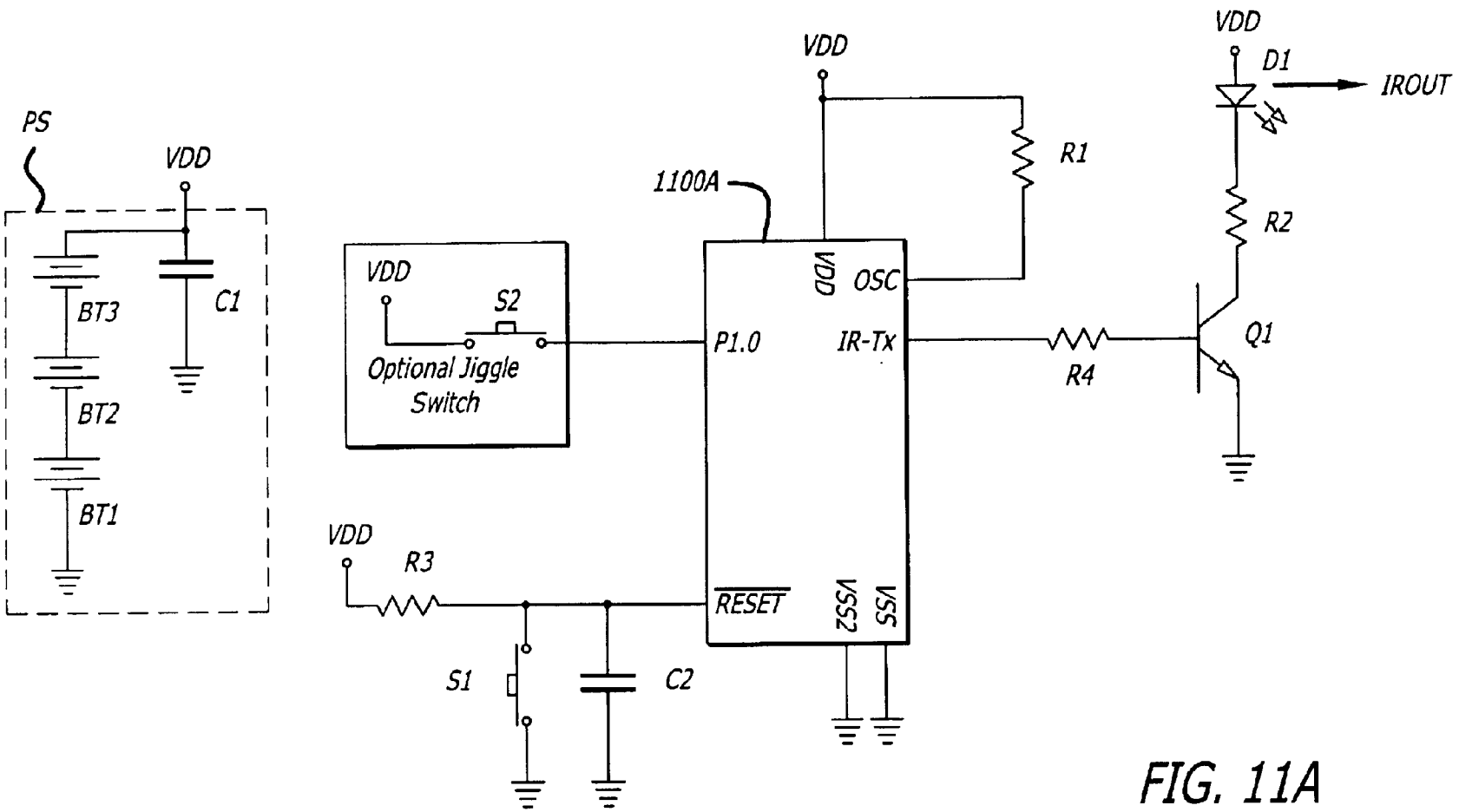
FIG. 11A illustrates an electrical schematic for an embodiment of a toy character/object.
Figure 11B:
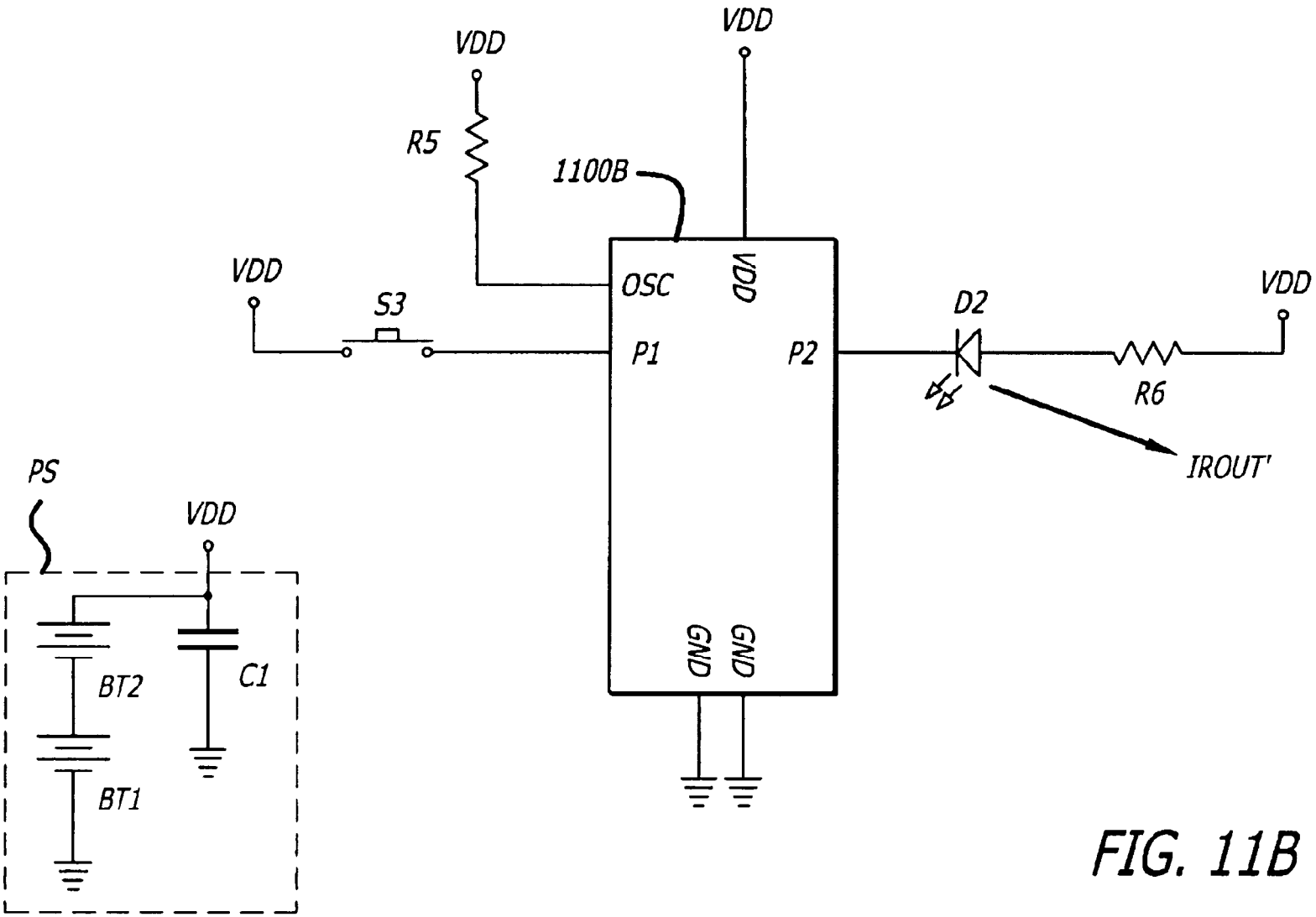
FIG. 11B illustrates an electrical schematic for another embodiment of a toy character/object.

Referring now to FIGS. 11A and 11B, schematic diagrams of the typical transmitter electronics within a wireless toy character or doll 400 is illustrated. Each wireless toy character 400 has transmitter electronics that pulses the IR emitting diode with a unique identification pattern upon activation. That is, the transmitter electronics of the wireless toy characters in FIGS. 11A and 11B generate wireless infrared output signals (IROUT and IROUT') from an infrared emitter D1, D2 in response to being activated by one or more switches S1–S3. The wireless infrared output signals (IROUT and IROUT') may be programmed to be unique to the respective character 400. FIGS. 5A–5B illustrate how the transmitter electronics may mounted inside the body of the wireless toy character 400.

Referring to FIG. 11A, the transmitter electronics includes an integrated circuit 1100A, a reset switch S1, a start switch S2, one or more batteries BT1–BT3, an infrared light emitting diode (IR-LED) D1, a switching transistor Q1, capacitors C1 and C2, and resistors R1–R4 coupled together as shown and illustrated. The integrated circuit 1100A may be a commercially available microcontroller (e.g., a Sunplus SPEF06A) or a custom circuit. Alternatively, the integrated circuit 1100A may be assembled together by discrete logic components but may require more space inside the wireless toy character 400. In any case, the integrated circuit 1100A has programmable identification fields and transmission timing as will be discussed more fully below. The transmitter electronics are powered by a power supply PS, made up of the one or more batteries BT1–BT3 and the filtering capacitor C1. In a preferred embodiment, the batteries BT1–BT3 are three LR44 button battery cells and capacitor C1 is a 0.10 uf capacitor. Resistor R1, having a resistance of 56K in a preferred embodiment, is coupled at one end to the positive power supply VDD and to the oscillator input OSC of the IC 1100A at an opposite end. Resistor R2 couples between the collector of transistor Q1 and the cathode of the IR LED D1. The anode of the IR LED D1 is coupled to the positive power supply terminal VDD. The emitter of transistor Q1 is coupled to ground or the negative power supply terminal, ground. Transistor Q1 is a bipolar junction transistor to switch the IR-LED on and off, an 2SC9012 in a preferred embodiment. Resistor R3 is coupled between the positive power supply terminal VDD and reset input of the IC 1100A. Capacitor C2 filters out noise by being coupled across the reset input of the IC 1100A and the negative power supply terminal, ground. Resistor R4 is coupled between the base of transistor Q1 and IR-TX output of the IC 1100A.

The integrated circuit 1100A can be started or activated, for example, by means of switches S1 or S2 operable by a user. Switch S1 may be manually selected to reset the integrated circuit 1100A and start up an identification sequence which is repeatedly transmitted by the wireless toy character 400. That is, switch S1 is a user operable switch that may be directly operated by a user. Switch S2 may be automatically selected by a user through motion of the wireless toy character 400, for example. That is, switch S2 may sense some action of the user, such as a jiggling or other movement the wireless toy character 400. Switch S2 is an optional jiggle switch that closes upon sensing sufficient movement to couple the positive power supply VDD into the input P1.0 of the integrated circuit 1100A. Switch S1 when closed, couples the negative power supply Gnd into the reset input of the integrated circuit 1100A to reset and activate the integrated circuit 1100A. In either or both cases of switches S1 and S2, it may be required that the switch be pressed or switched for a period of time, one second for example, before the integrated circuit 1100A is activated. This time period requirement may be used to prevent accidental triggering of a wireless emission or transmission from the wireless toy character 400.

Upon activation, the integrated circuit 1100A drives one or more wireless emitters, such as the IR LED D1, to emit a unique wireless transmission pattern or signal, referred to as IROUT signal. The IR-TX output from the integrated circuit 1100A causes transistor Q1 to switch ON and OFF generating an electrical current signal through the IR LED D1. The electrical current signal through IRLED D1 is transduced into an wireless signal, IROUT.

In the preferred embodiment, the emitter is an infrared emitter and the unique wireless transmission pattern or signal IROUT is in the form of infrared (IR) radiation or infrared optical signal. The wireless transmission pattern or signal IROUT may consist of a variable length pulse modulated on a carrier frequency of 40 kHz, for example. However other transmission modes may be used including a direct signaling method disclosed in U.S. Ser. No. 10/170,489, entitled "System, Method, and Apparatus for Bi-directional Infrared Communication" by David Small and James Hair filed on Jun. 12, 2002 which is incorporated herein by reference. The emission levels or amplitude of the signal IROUT may be optimized for an appropriate distance. That is, the emission level or amplitude of the IROUT signal may be limited in the radiation level or intensity at a certain distance away from the emitter IR LED D1 so that it is not sensed by a detector or receiver. In this manner a longer path of reflections, such as from outside of the doll house to a wall of a users room and back will be of an insufficient level to activate the detectors. At the same time, the emission level or amplitude of the IROUT signal may be limited in the radiation level or intensity at a certain distance away from the emitter IR LED D1, in the immediate locale of the doll house (such as within a doll house room for example), will be of a sufficient level to activate the detector.

Referring now to FIG. 11B, another exemplary embodiment of transmitter electronics is illustrated for a wireless toy character 400. The transmitter electronics includes an integrated circuit 110B, a start switch S3, one or more batteries BT1–BT2, an infrared light emitting diode IR-LED D2, a capacitor C1, and resistors R5–R6 coupled together as shown and illustrated. The integrated circuit 1100B may be a commercially available microcontroller (e.g., a Sonix SN67d03) or a custom circuit. Alternatively, the integrated circuit 1100B may be assembled together by discrete logic components but may require more space inside the wireless toy character 400. In any case, the integrated circuit 1100B has programmable identification fields and transmission timing as will be discussed more fully below. The transmitter electronics are powered by a power supply PS, made up of the one or more batteries BT1–BT2 and the filtering capacitor C1. In a preferred embodiment, the batteries BT1–BT2 are a pair of LR54 battery cells and capacitor Cl is a 0.10 uf capacitor. Resistor R5, having a resistance of 330K in a preferred embodiment, is coupled at one end to the positive power supply VDD and to the oscillator input OSC of the IC 1100B at an opposite end. Resistor R6 couples between the positive power supply VDD and the anode of the IR LED D2. The cathode of the IR LED D2 is coupled to the output terminal P2 of the integrated circuit 1100B to receive a modulated electrical signal. An electrical current signal is generated at the output terminal P2 of the integrated circuit 1100B and through the IR LED D2. The wireless emitter, IRLED D2, generates the IROUT' signal responsive thereto in the form of an infrared optical signal in a preferred embodiment. The data signal modulated into the IROUT' signal will be discussed with reference to FIGS. 13–15 below.

Switch S3 couples between the positive power supply VDD and the input P1 of the integrated circuit 1100B. Switch S3 may be the jiggle switch S2 or the manual switch S1 and function as previously described. In either case, switch S3 activates the integrated circuit 1100B to generate an IROUT' signal transmission.

Figures 1, 12:
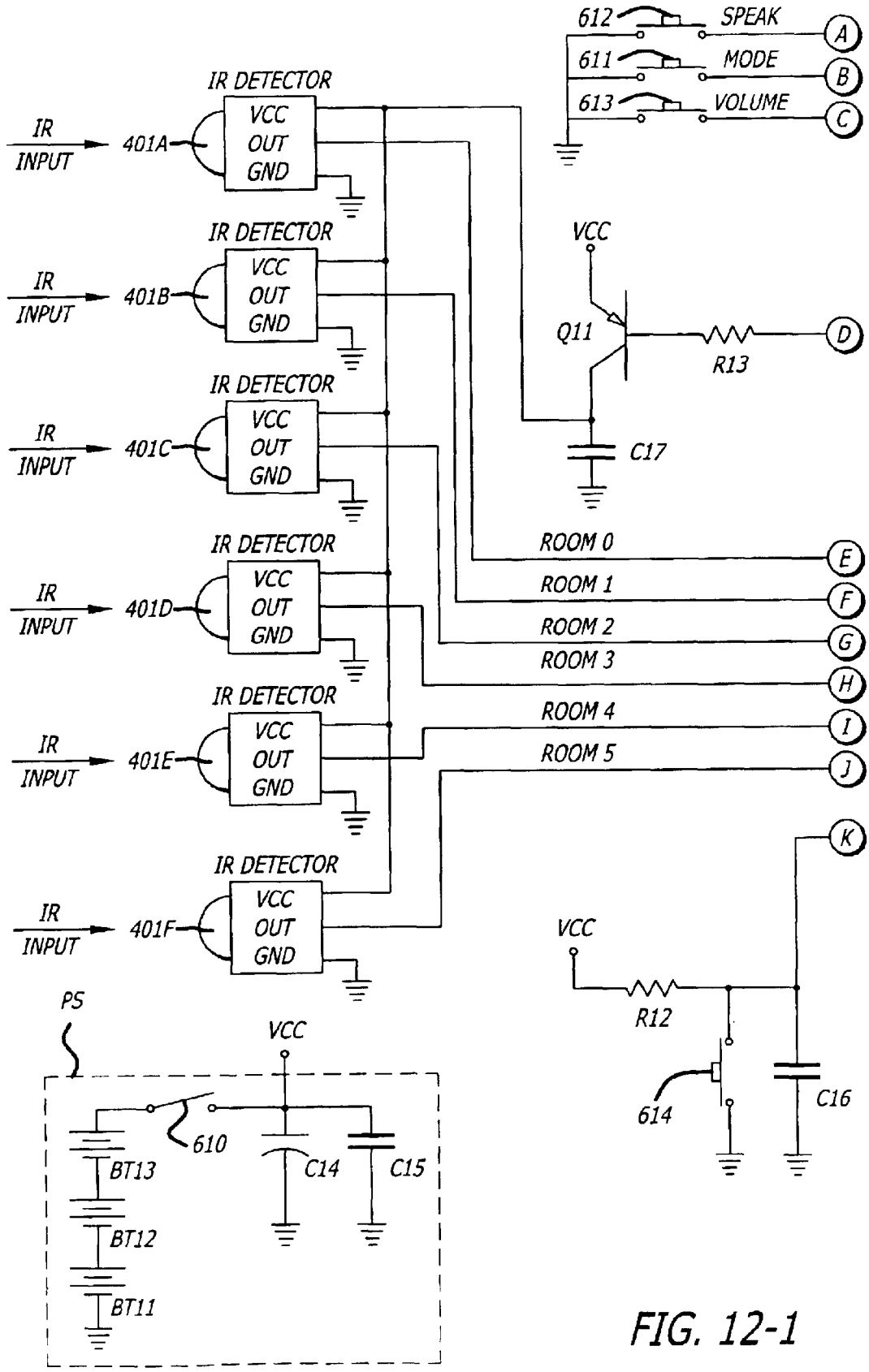
Figures 2, 12:
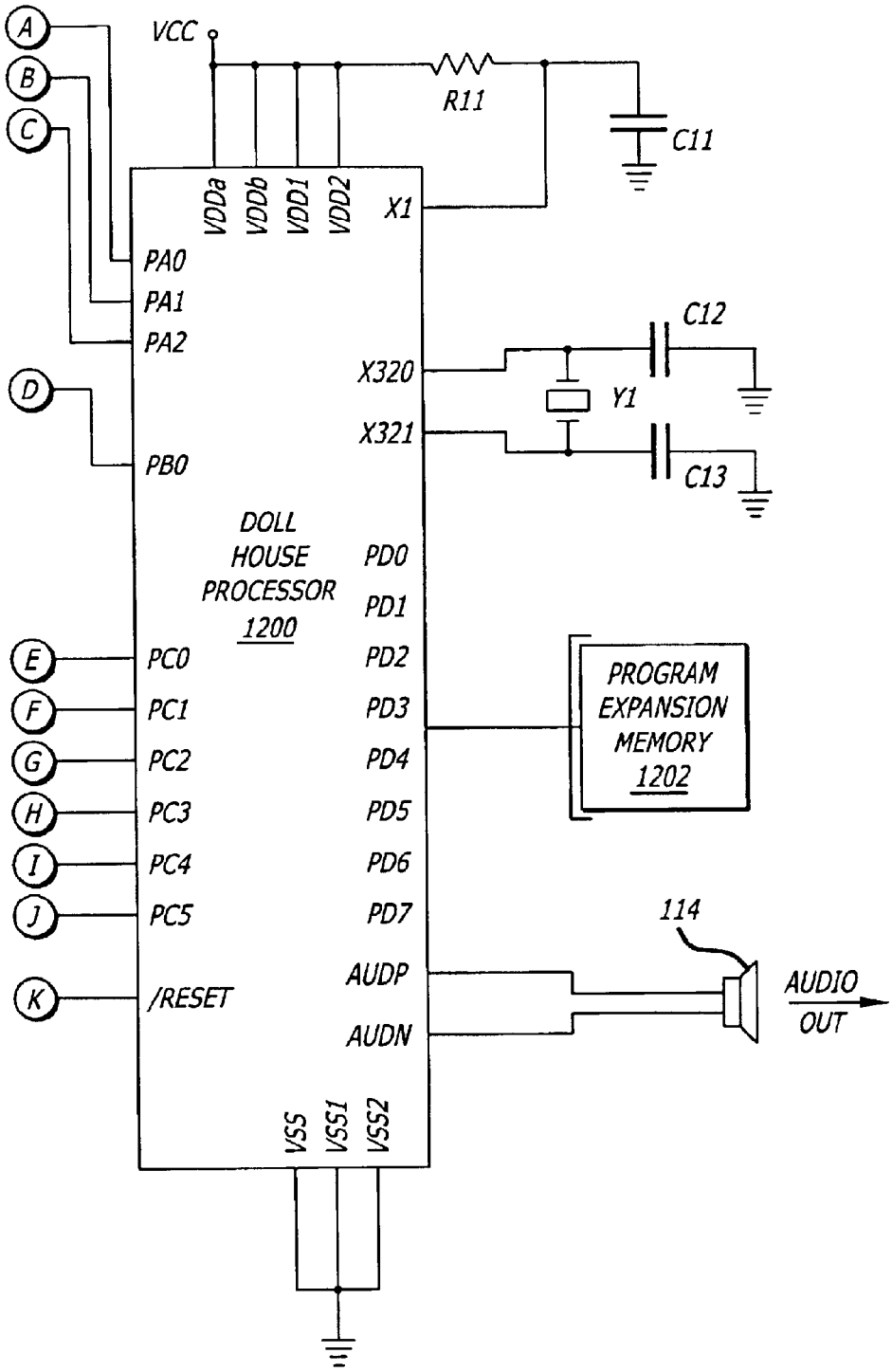

Referring now to FIG. 12-1 and 12-2, an exemplary schematic of the doll house receiver electronics for the wireless electronic doll house 100 is illustrated. The wireless signals IROUT emitted by the wireless toy characters 400 or objects are detected by the doll house receiver electronics. The exemplary schematic of doll house receiver electronics illustrated in FIG. 12 may include a doll house processor or microcontroller 1200, one or more infrared detectors 401A–401F, the speaker 114, switches 610–614, capacitors C11–C17, resistors R11–R13, quartz crystal Y1, BJT transistor Q11, and one or more batteries BT11–BT13 coupled together as shown. The doll house receiver electronics may further include a program expansion memory 1202 or a connector for interfacing to the doll house processor or microcontroller 1200 in order to update the program, expand functionality, or add additional scripts for the wireless characters 400. The infrared detectors 401A–401F are strategically located within the wired doll house 100 within each room, for example. Other elements of the doll house receiver electronics may be physically provided within the wired doll house 100 as discussed previously with reference to FIG. 6.

In one embodiment, the doll house processor or microcontroller 1200 is a Sunplus SPDS106A single chip controller including a number of data input/output ports, a crystal oscillator, and an audio output port. The doll house processor or microcontroller 1200 includes a memory for storing a program. The doll house processor or microcontroller 1200 is programmable in order to implement a software program for detecting the wireless characters 400 within rooms of the doll-house 100 and for execution of stored audio scripts related thereto. The software program can be updated or enhanced through the program expansion memory 1202 or other means. Alternatively, the program expansion memory 1202 may be utilized to provide additional scripts for pre-existing wireless characters 400 or for new wireless characters 400 that may be added into a doll-house playset. In other embodiments, the functionality of the doll house processor or microcontroller 1200 may be implemented using multiple chips, multiple microprocessors, or a combination of discrete parts and/or ASICs.

Switches 610–614 may be used to operate the wireless interactive doll house 100. Switches 611–614 are momentary switches that couple between ground and an input to the doll-house processor 1200. Switch 610 is a slider, a toggle, or throw switch that can make a fixed or semi-permanent electrical connection in a closed position. Switch 610 couples between a battery terminal and the positive power supply terminal VDD of the power supply PS. The On/Off switch 610 is used by a user to turn the receiver electronics of the wireless doll house 100 on and off. Switches 611–614 electrically couple a user selection into the doll-house processor or microcontroller 1200. Mode switch 611 is used to set the mode of operation of the wireless doll-house to either speak automatically upon movement of characters or objects or to speak manually upon depression of the speak switch 612. Speak switch 612 is used to command the interactive doll house to speak based on the current placement of wireless characters 400 in the rooms of the doll-house, particularly when the mode is set to speak manually. Volume switch 613 is used to adjust the speaker volume or amplitude of the speaker 114 up or down. An optional reset switch 614 may be provided in order to manually reset the receiver electronics of the wireless doll-house 100. The optional reset switch 614 has one terminal coupled to the reset input terminal of the doll-house processor 1200.

Speaker 114 couples to the audio output terminals of the doll-house processor 1200 in order to provide audible sounds or character scripts associated with the wireless characters 400 when placed and detected within a room of the doll-house 100. That is, the receiver electronics of the doll house illustrated in FIG. 12 receive one or more infrared input signals (IR INPUT) into the one or more infrared detectors 401A–401F and generates the audible output sound signal (AUDIO OUT) in response thereto.

The crystal Y1 in conjunction with the capacitors C12 and C13 couple into the crystal input terminals of the doll house processor 1200. The crystal Y1 is a quartz crystal utilized in an oscillator circuit to establish an accurate clock frequency. Capacitors C12 and C13 are of substantially equal capacitance and are twenty picofarrads in one embodiment.

The one or more infrared detectors 401A–401F are electrically coupled in parallel to the doll-house processor or microcontroller 1200 through the ROOMi signal lines (ROOM0–ROOM5). The one or more infrared detectors 401A–401F respectively receive one or more infrared input signals (IR INPUT) and generate an electrical signal (e.g., a current) in response thereto on the respective ROOMi signal line. In one embodiment, one or more infrared detectors 401A–401F are similar to those commonly used in TV and consumer electronic IR remote control products.

The one or more infrared detectors 401A–401F may have the power provided to them cycled on and off in order to conserve power in the wireless doll-house 100. Transistor Q11 switches the power provided by the power terminal VCC on and off to the one or more infrared detectors 401A–401F in response to a control signal from the doll-house processor 1200. The power pin VCC of each of the one or more IR detectors 401A–401F are coupled together to the collector of transistor Q1 and a first terminal of capacitor C17. The base of transistor Q1 is coupled to the PB0 output terminal of the doll-house processor or microcontroller 1200 through the resistor R13. The emitter of the transistor Q1 is coupled to the positive power supply terminal VCC from the power supply PS. A signal from the output PBO from the doll-house processor 1200 controls the switching of transistor Q1 as to whether power is supplied or not to the one or more infrared detectors 401A–401F. The power to the one or more infrared detectors 401A–401F may be turned off for example when the doll-house processor 1200 goes into sleep mode to conserve battery power.

The output pin OUT from each of the one or more infrared detectors 401A–401F is coupled to a respective input (PCO–PC5) of the doll-house processor 1200 through the respective ROOMi signal line (ROOM0–ROOM5). The output pin OUT from the one or more infrared detectors 401A–401F will generate an electrical signal thereon upon detecting an IR INPUT signal. That is, the one or more infrared detectors 401A–401F will generate an output signal thereon upon detecting the output signal from a character 400. The output signal on the respective output pin OUT and respective ROOMi signal line is coupled into the doll-house processor 1200 for further analysis and demodulation of the data signal contained therein. In one embodiment the wireless characters 400 generate the ID data signal on an infrared carrier modulated at 40 kHz which may be detected by the one or more infrared detectors 401A–401F. The 40 kHz modulated IR ID signal transmitted from the characters 400 within the doll-house 100 are detected by the IR detectors 401 and their data signal is coupled into the doll-house processor or microcontroller 1200.

The one or more batteries BT11–BT13 in conjunction with the switch 610, capacitors C14 and C15 are the power supply PS to the wireless interactive doll-house 100. The power supply provides a positive supply voltage on the positive power supply terminal VDD. In one embodiment, the one or more batteries BT11–BT13 are three AAA batteries coupled in series to provide 4.5 volts nominally. The on/off switch 610 when closed, couples the battery power to the positive power supply terminal VDD and the electrical components of the wireless interactive doll-house 100.

Referring now to FIG. 13, a table of an exemplary set of waveform identifiers 1306, ID data packets 1302 (i.e., doll number 1412 in FIGS. 14–15), and repetition rates 1304 for an exemplary family of wireless toy characters 400 is illustrated for the purposes of discussion herein. It is understood that these values are only exemplary and that other values and other identifiers may be used to identify each toy character. That is, the table illustrates sample code values and varying transmit timing rate for an exemplary set of various wireless toy characters or objects 400. Additional data fields may be added or the device number 1414 may be used so that further information may be transmitted about each of the wireless toy characters 400.

In order to further distinguish among each wireless toy character 400, the repetition rates 1304 differ from each as does the ID data packet 1302. For example, consider the birthday cake as the wireless toy character 400. The ID data packet 1302 is 00101 which is repeated over a fixed period of time at the rate of three cycles per second (3.0 cycles/sec.) for the birthday cake. In contrast, consider the Dad as the wireless toy character. The ID data packet 1302 is 00001 which is repeated over a fixed period of time at the rate of ten cycles per second (10.0 cycles/sec.) for the dad. The repetition rate for the wireless toy characters may also be chosen on the level of recognition importance of the character. That is, it may be more important to recognize the presence of Dad in a room, for example, then the presence of the birthday cake in a room. The differences in repetition rate for the wireless toy characters also allows for each to be received at different times to help avoid overlapping signals.

Figure 14:
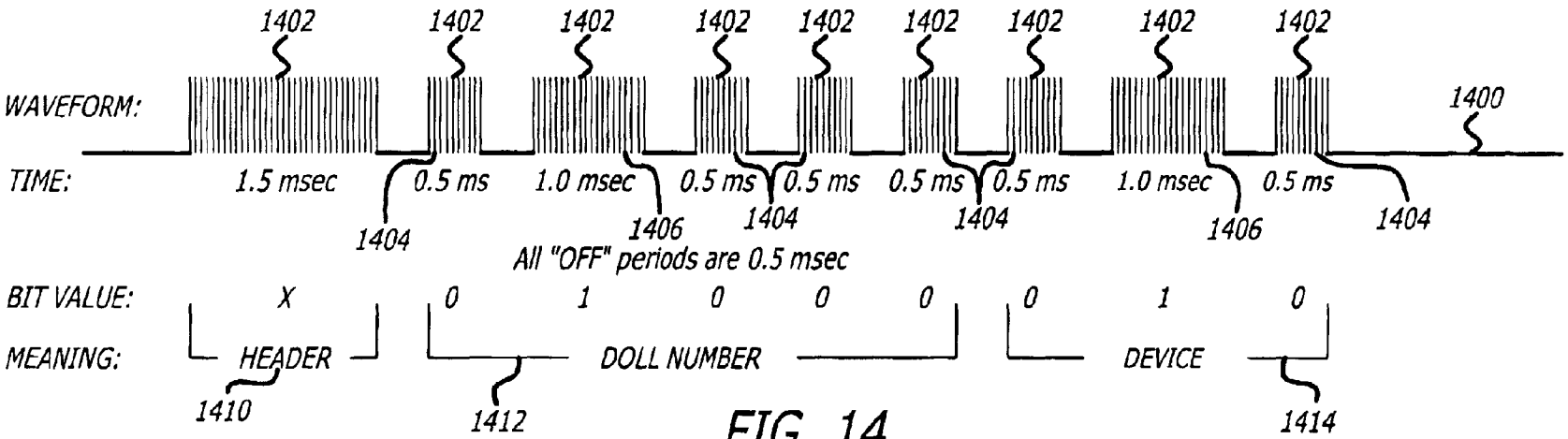
FIG. 14 illustrates an exemplary waveform diagram generated by an exemplary toy character/object for wireless transmission to a wireless interactive doll-house.
Figure 15:
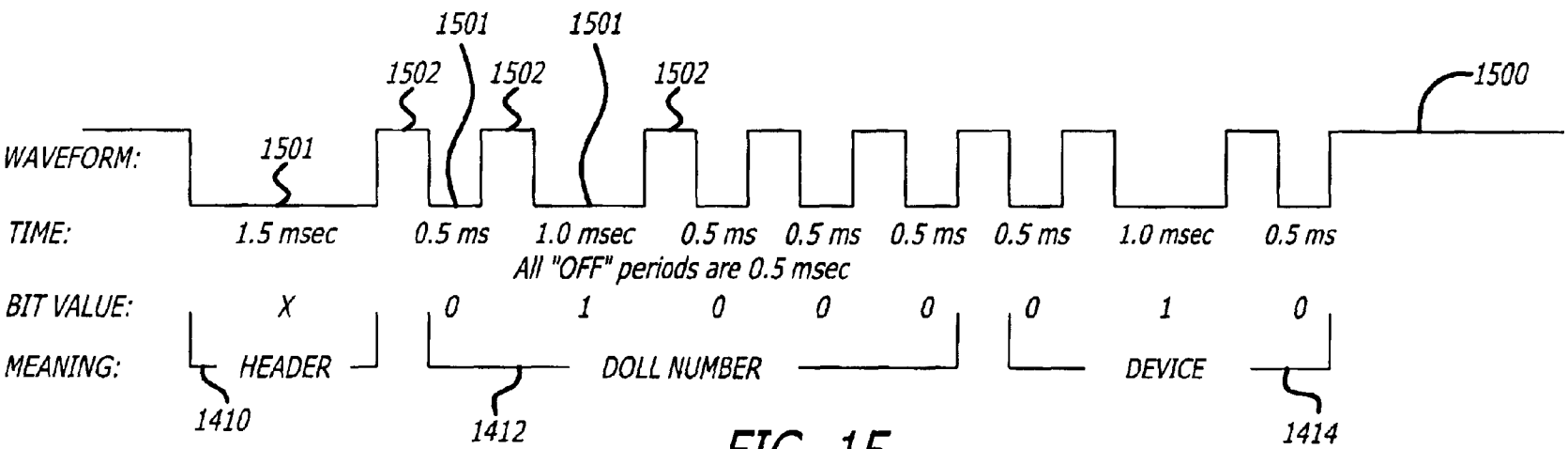
FIG. 15 illustrates an exemplary waveform diagram received by a wireless interactive doll-house corresponding to the wireless transmission of the exemplary waveform diagram of FIG. 14.

FIGS. 14–15 illustrate exemplary waveforms including a serial object identification sequence for detecting a wireless toy character within a room of the wireless doll-house.

Referring now to FIG. 14, an exemplary transmitted ID waveform 1400 is shown. The waveform 1400 is made up of a series of modulated 40 kilohertz (kHz) IR transmission bursts 1402. The typical period for each single wide pulse 1402 is approximately 0.5 milliseconds (ms) in one embodiment. The total time period for the whole waveform 1400 is approximately 10.5 ms. In this embodiment logical zeroes 1404 may be sent as a single width pulse (i.e., 0.5 ms pulse) and logical ones 1406 may be sent as double wide pulses (i.e., a 1 ms pulse). The off periods between the transmission bursts 1402 may be 0.5 ms in duration in one embodiment. It is obvious that the format of the transmitted ID waveform 1400 and the pulse widths of transmission bursts for representing logical ones or zeros may be varied.

The first pulse 1410 in the ID waveform is a three wide header calibration pulse 1410 of approximately 1.5 ms which is used by the doll-house to calibrate the time period of the single wide 0.5 ms pulse and the double wide 1 ms pulses that are to follow. The next sequence of pulses 1412 in the ID waveform 1400 are for indicating the doll or character number. The next sequence of pulses 1414 in the ID waveform 1400 are for indicating a device number. The device number is currently a fixed number but is reserved for future expansion, functionality, programmability and differentiation between wireless toy characters 400.

The header calibration pulse 1410 is provided because the wireless doll-house 100 and the wireless toy characters or objects 400 that communicate with the wireless doll-house 100 may be operating at different frequencies. This may be due to variations in the frequencies of the processor clock (i.e., oscillator variation) in each. The processor clocks may vary due to differences in battery power supply voltages, temperature, timing resistors tolerances or variations in the manufacture of the microcontroller integrated circuits (e.g., ICs 1100A–1100B). For instance at a high voltage power supply level, the clock of the CPU may run faster and a logical one may be 100 clocks (i.e., 100 clock cycles), while at a low voltage power supply level the same signal may be only 75 clocks. The doll-house processor (i.e., the processor or microcontroller in the doll-house) analyzes the pulse widths of the header calibration pulses 1401 that it receives and by such analysis it can determine what the pulse length of a "logical 1" or a "logical 0" pulse. The doll-house processor does this by analyzing the header pulse width 1410 at the start of the ID packet for any device that is in a known format so that it knows what is being sent as a one and what is being sent as a zero. Using the measured header pulse time period, the doll-house processor can accurately determine the time periods that the wireless toy characters 400 are using to transmit logical ones or zeroes. The triple long header pulse 1410 is also used to uniquely identify the start of a valid transmission.

The data in the waveform of FIG. 14 is represented in serial format with the most significant bit (MSB) presented first. The device bits 1414 comprise a code to identify what kind of device is sending the data. In one embodiment the device bits 1414 are set to 010 binary (010b) for all the dolls. The device bits 1414 may be used to help distinguish dolls, furniture, different families, different settings (e.g., office, home, work), etc. Otherwise, the device bits 1414 may be used for further expansion.

The command portion or doll number 1412 (i.e., ID data 1302 in FIG. 13) may consist of five binary bits which allows for command numbers from 0 (00000b) to 31 (11111b). The exemplary waveform 1400 of FIG. 14 illustrates a waveform for a doll number 2 (00010b). Doll number 2, for example, may be "mom" among the wireless toy characters 400 communicating with the wireless doll-house 100 as its depicted in the table of FIG. 13.

Referring now to FIG. 15 and to FIGS. 12-1 and 12-2, a typical waveform 1500 (corresponding to waveform 1400 of FIG. 14) is illustrated which is received and demodulated by the receiver electronics of the wireless doll-house 100. The waveform 1500 has a serial data stream which is further analyzed by the doll-house processor 1200 to determine the doll number 1412 and the device number 1414 for a wireless character. In one embodiment, the IR detectors 401 generate active low signals 1501 on the output terminals OUT in response to detecting a 40 kHz infrared carrier signal from a wireless toy character 400. In absence of the 40 kHz infrared carrier signal, the IR detectors 401 allow the output terminals OUT to be pulled up to a high signal level 1502. The doll-house processor 1200 receives the active low signals 1501 on the output terminals OUT from the IR detectors 401 in response to the receiving modulated 40 kHz carrier signals and the high signal levels 1502 when the modulated 40 kHz carrier signal is not detected. The waveform 1500 illustrates an example of the waveform on a ROOMi (where i is a variable) signal line for a given wireless character in ROOMi that is received by the doll-house processor 1200. The doll-house processor analyzes the serial data stream in the waveform to detect the header 1410, and the bits of the doll number 1412, and the bits of the device number 1414. In response to the ID received, the doll-house processor may generate an audible script or sounds as the AUDIO OUT signal.

The doll-house processor 1200 is programmed to scan the rooms within the doll-house 100 in parallel and detect wireless signals therein. That is, the wireless doll-house 100 and the doll-house processor 1200 looks at each IR receiver 401 in a parallel fashion to detect if one or more characters 400 are within the rooms (corresponding to ROOM0–ROOM5 signal lines) of the doll-house 100.

However, the data stream from a wireless character 400 may be transmitted in a serial fashion to the doll-house 100. The doll-house and the doll-house processor 1200 use a room scanning routine in an attempt to obtain a serial data stream and evaluate the presence of a valid IR transmission from a wireless character 400. An input register is present within the doll-house processor 1200 to store bits of data in parallel on the ROOMi signal lines from each room. During the room scanning routine, the doll-house processor 1200 takes a snapshot of the input register and stores this value within a page of memory of the doll-house processor 1200 to obtain a part of the serial data stream. The room scanning routine repeats over and over in a loop obtaining a part of the serial data stream for each room once every 'loop' of the room scanning software.

The room scanning routine is a software loop which is continuously executed. During the room scanning routine, all room receivers are sampled simultaneously and then the sampled states are processed sequentially, one room at a time by a room processing routine.

FIG. 16A illustrates a flow chart diagram of an embodiment of a room scanning routine executed by the doll-house processor 1200. The process starts at block 1600 upon power up and continues in a loop thereafter. At block 1602, input registers coupled to the ROOMi lines are clocked in order to simultaneously sample the ROOMi signals. Next at block 1604, the value stored in the input registers is stored into memory. Then at block 1606, a room processing routine is called to evaluate the new values.

Figures 1, 16B:
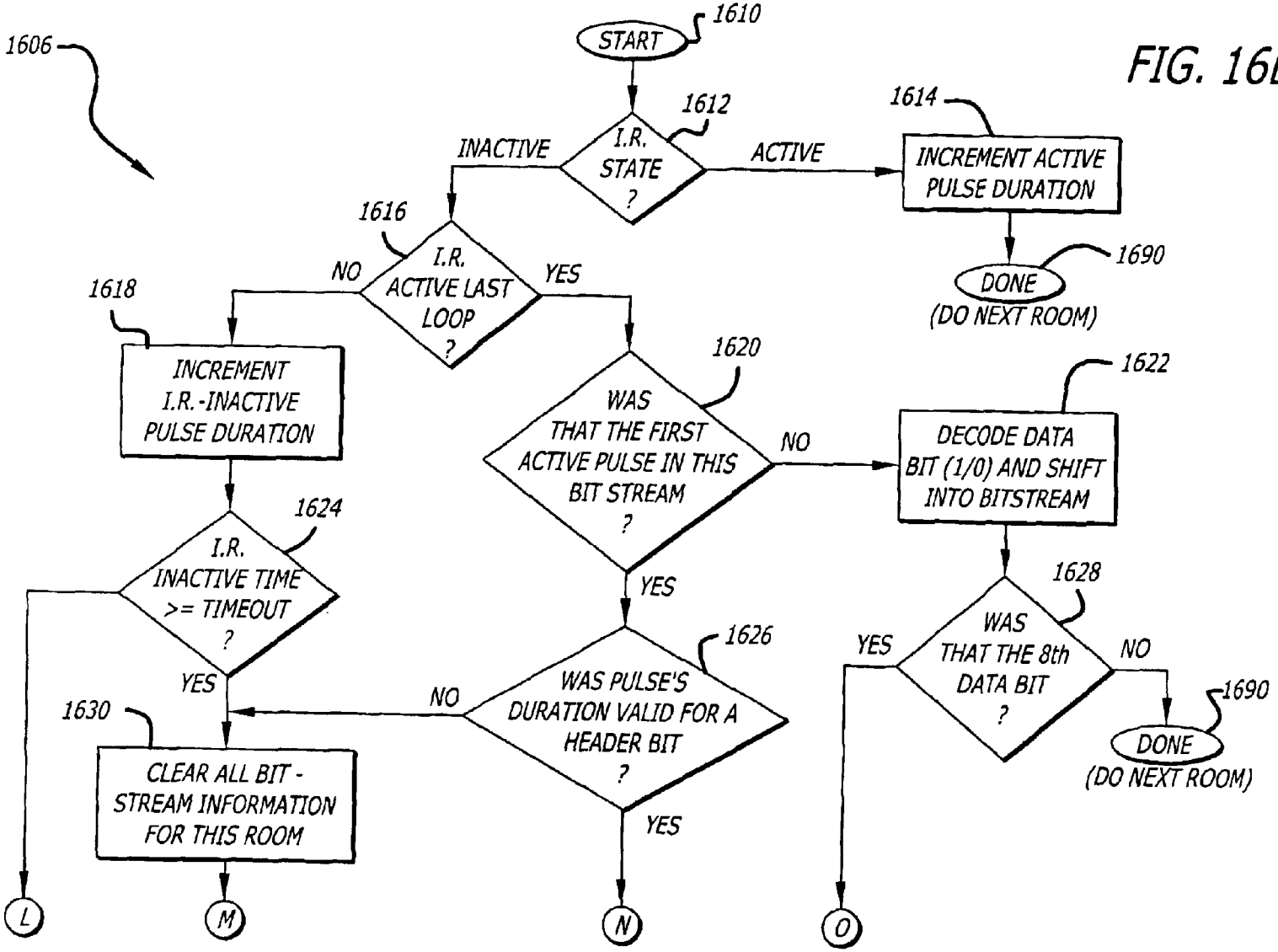
Figures 2, 16B:
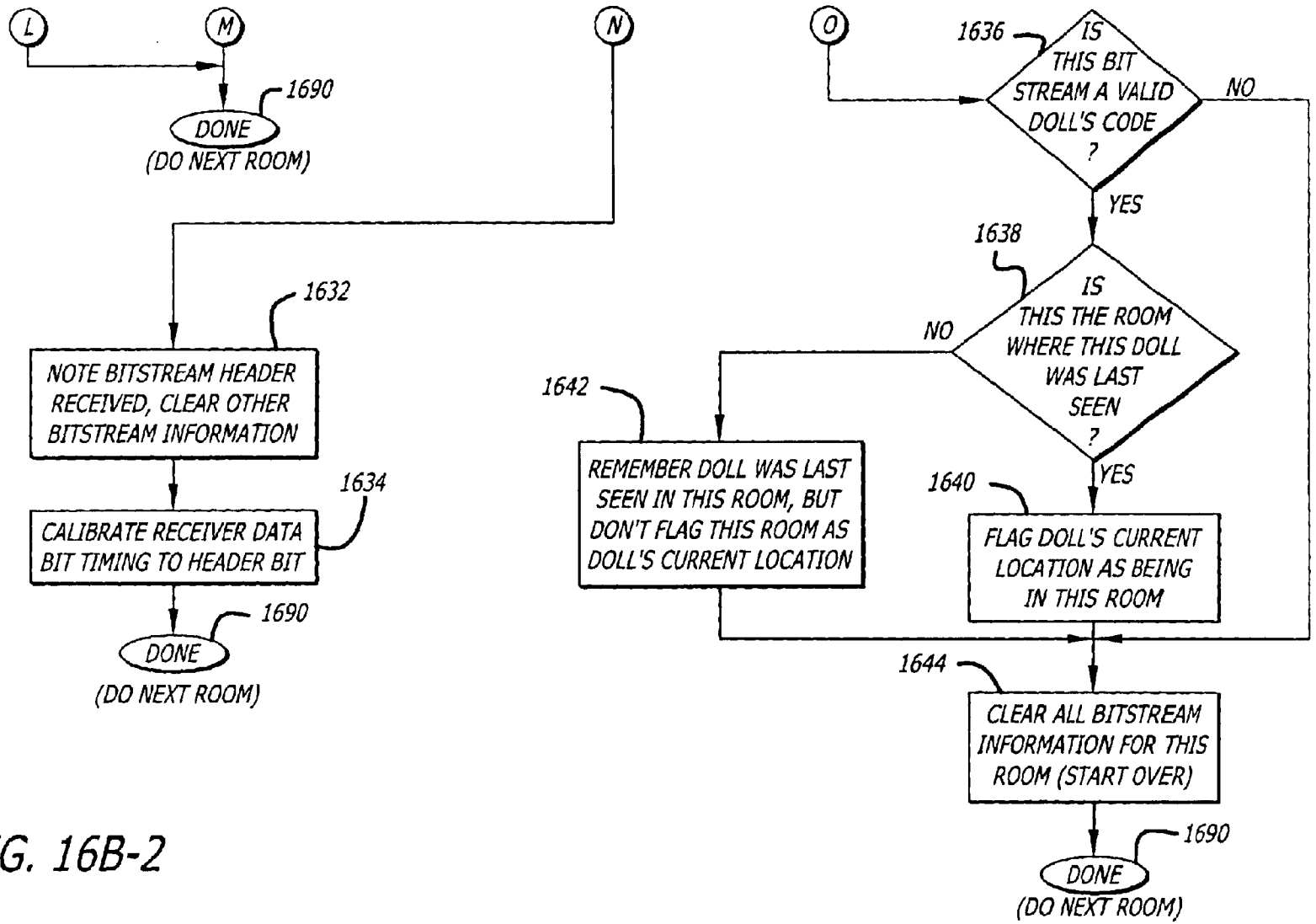

Referring now to FIGS. 16B-1 and 16B-2, a flow chart diagram is illustrated of an embodiment of the room processing routine executed by the doll-house processor 1200. The process begins with a ROOMi at block 1610.

At block 1612, the process initially determines whether the room's receiver is in an IR-present ("active") or IR-not-present ("inactive") state.

If active, an active pulse duration timer is incremented at block 1614 to determine how long a time (expressed in number of consecutive software loops) it has been in the active state.

If inactive, at block 1616 a determination is made whether or not the specific ROOMi's receiver was in the active state during the last loop of the software routine, in order to detect transitions.

If block 1616 determines the receiver for the given room was in the inactive state during the last loop as well, an inactive pulse duration timer is incremented at block 1618 to determine how long a time (expressed in number of consecutive software loops) it has been in the inactive state. Then, the software routine jumps to block 1624 to determine if the time stored in the inactive pulse duration timer is greater than a timeout value. In one embodiment, the timeout value is sixty-four (64) loops of the room scanning routine of FIG. 16A. In another embodiment, the timeout value is twice the duration of the header bit of the current bitstream. If the timeout value has not been exceeded, this loop of the software routine is done at block 1690 and it can then process the next room. If the timeout value has been exceeded, then the software routine jumps to block 1630. That is, if at any time the inactive state of a room's receiver lasts for longer than sixty-four (64) loops or two times the duration of the header bit in the current bitstream (if a valid header bit has been received), the bitstream information for the room is cleared and the timing information restarted to indicate that the bitstream has been lost or corrupted at block 1630. Then, this loop of the software routine is done at block 1690 and it can then process the next room.

If block 1616 determines the receiver for the given room was in the active state during the last loop), a transition from active to inactive state is detected and the routine jumps to block 1620.

At block 1620, a determination is made as to whether or not that was the first active pulse in the given bitstream to check whether this potential bit is a header bit (the first bit in a bitstream) or a data bit (all subsequent bits in a bitstream).

If at block 1620 the potential bit is determined to be a header bit, then the software routine jumps to block 1626. At block 1626, the duration of the potential bit is checked to determine if it is of a valid duration for an expected header bit. If it is a valid duration for a header bit, then the routine jumps to block 1632 where the room is recorded as having received a valid header bit in it's bitstream and other bitstream information is cleared for the given room. Then, the duration of the received header bit is used to calibrate the receiver timing to the transmitter timing at block 1634 and this loop of the software routine is done at block 1690 and it can then process the next room. If at block 1626 the header bit is determined to be invalid because it is either too long or too short in duration, the bit is discarded and the given room is considered to have received neither a header bit nor any other bitstream information. At block 1630, all bitstream information is cleared for the given room and this loop of the software routine is done at block 1690 and it can then process the next room.

Alternately at block 1620, if the bit is determined to be a data bit (that is, a valid header bit has previously been seen in this room's bitstream and it is not the first active pulse in the bitstream), then the software routine jumps to block 1622.

At block 1622, the calibration timing from the prior received header bit is used to determine if the given data bit is a logical one or a logical zero, and the appropriate logical value is shifted into the received bitstream (e.g., stored in a shift register of the processor) for the given room.

Then at block 1628, a determination is made whether or not the given data bit is the eighth data bit (i.e., the nth data bit of an expected n-bit data stream). If it is not the eighth data bit, this loop of the software routine is done at block 1690 and it can then process the next room. If it is the eighth data bit, the software routine jumps to block 1636.

Once the room has received a header bit and 8 data bits consecutively, the data bits are evaluated to determine if they form a valid signature for one of the dolls.

At block 1636, a determination is made as to whether or not the data bits of the given bit stream correspond to one of one or more predetermined doll codes known to the doll-house to form a valid doll code. If a valid doll code is not determined, (i.e., an invalid signature), the software routine jumps to block 1644 where the bitstream information stored for this room is cleared to start over during the next loop of the room scanning routine of FIG. 16A.

If a valid doll code (i.e., a valid signature) for one of the dolls is detected then the doll's position with the respective signature is updated. This position updating consists of checking to see if the doll was last seen in this room at block 1638 and if so, then the doll's present position is updated to indicate that it is currently present in this room at block 1640.

Alternatively, if at block 1638 it is determined that the doll was previously seen in a different room, or not seen at all, then the software routine jumps to block 1642. At block 1642, the doll is recorded as having been seen most recently in this room, but the doll's present position is not immediately updated—this will be done upon having seen the doll's signature twice consecutively in the same room. That is, the given room is not flagged as the doll's current location unless a valid signature for the given doll is detected in the same room in consecutive loops of this room processing routine. Then the software routine jumps to block 1644 where the bitstream information stored for the given room is cleared and to start over during the next loop of the room scanning routine of FIG. 16A. Then, this loop of the software routine is done at block 1690 and it can then process the next room.

If the last room is processed in the room processing routine of FIG. 16B, the next loop of the room scanning routine of FIG. 16A can begin. That is, the room processing routine of FIG. 16B can be completed between clocks of the input registers to sample the ROOMi signals.

When multiple characters 400 are in the same room at the same time, their transmitted signals may overlap and clash with one another over a given period of time. This overlap during the given period of time can result in the generation of invalid data, which is cleared.

To allow characters 400 in the same room at the same time to be recognized, each character 400 may have a different repetition rate 1304 over which they transmit their ID signatures. This staggers over time the transmission of each respective ID signature of the multiple characters 400 in a room so that they are transmitted often and at differing intervals, thereby overcoming a potential clash of data.

The doll-house processor 1200 may further provide error correction/detection to eliminate ghost locations that may appear from moving characters around the doll-house or to avoid activation when characters 400 are outside of the doll-house 100 but still close enough to be marginally recognized by one or more rooms. The doll-house processor 1200 may maintain a list of last known locations (e.g., rooms) for each wireless character 400. When a wireless character 400 is recognized, the doll-house processor may store the new location (e.g., a room) and compare it to the last known location (e.g., a room). For error correction purposes the doll-house will not recognize a new location for a wireless character 400 unless the current position matches the last known location. That is for error detection/correction, a wireless character 400 needs to be recognized twice in the same room before the wireless doll-house 100 is activated to generate sounds or play a script of simulated dialogue from one or more characters 400.

Other embodiments can be practiced within the scope of this invention. The simplified wireless communication and location techniques can be used in other toys in addition to doll-houses such as action figure playsets, toy vehicles, models, toy army equipment and other devices. While IR signaling has been discussed, any other omni-directional signaling method that can have its signals blocked by means of a wall or divider such as ultrasonic sound, visible light, ultraviolet light or various forms of visible light can be used. While the hiding of the IR emitter by a blinder has been discussed as a novel feature, one can practice this invention with the emitter being visible. While one IR emitter has been discussed as part of the characters for the doll-house as being an inexpensive method of emitting light, for other reasons such as range, object shape, or style, more than one emitter may be employed in the characters. While a single system of detecting the location of the objects in a doll-house has been discussed, it is contemplated that it is possible to allow for multiple detection and response systems to be located in one doll-house and that these multiple systems may be hooked together by any variety of means that could include, but are not limited to a serial bus, a parallel bus, optical beams or radio communication.

Furthermore, error detection and correction techniques can be used over the IR communication link in order to enhance the reliability of the data transmissions. Some examples would include transmitting error correction and detection codes with each ID, encoding each command or ID with more than the minimal number of bits so that corruption of a command could be detected and corrected, using faster processors as a doll-house processor so that they can perform more analysis of the edge timings and momentary signal drops that might occur, and using multiple processors so each processor may only need to concentrate on a single room or less than a full set of rooms within a doll-house.

Furthermore, the doll-house may be another type of toy structure such as a toy office building with multiple offices interacting with office workers such as bosses and employees; a toy store with departments a fire station with multiple rooms interacting with firemen; a toy school house with multiple rooms interacting with children, teachers, and parents; as well as other toy structures having multiple rooms where a toy character may be placed and an interaction occur within that room. Alternatively, the doll-house may be a toy vehicle such as a toy car, toy school bus or toy fire truck with each seat or each row of seats defining a new IR reception area into which interaction would take place when a toy passenger or character is placed therein. With the scripts played by the toy doll-house, toy structure or toy vehicle being software programmable, the invention can be ready applied to any toy structures and toy characters.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. For example, while wireless interactive doll-houses have been described herein, the technology of the present invention may be used in other types of toy houses, housings, structures, or playsets so that wireless interaction can occur between a toy figure and said toy houses, housings, structures, or playsets therefor. Rather, the claimed invention should be construed according to the claims that follow below.

What is claimed is:

1. A wireless interactive doll-house comprising:

a first scaled room resembling a room of a home;

a first wireless receiver mounted in the first scaled room to receive wireless transmissions from one or more wireless toy characters;

a processor coupled to the first wireless receiver, the processor to analyze the wireless transmissions to determine which of the one or more wireless toy characters are located within the first scaled room; and a loudspeaker coupled to the processor to receive a signal associated with at least one of the one or more wireless toy characters, the loudspeaker to transduce the signal into an audible signal.

2. The wireless interactive doll-house of claim 1, wherein the audible signal is an audible sound associated with the at least one of the one or more wireless toy characters.

3. The wireless interactive doll-house of claim 1, wherein the audible signal is a scripted audible dialogue associated with the at least one of the one or more wireless toy characters.

4. The wireless interactive doll-house of claim 1, wherein the one or more wireless toy characters are infrared toy characters, the wireless transmissions are infrared wireless transmissions, and the wireless receiver is an infrared detector.

5. The wireless interactive doll-house of claim 1, further comprising:

a second scaled room resembling a room of a home;

a second wireless receiver mounted in the second scaled room to receive wireless transmissions from the one or more wireless toy characters, the second wireless receiver coupled to the processor, and wherein, the processor to analyze the wireless transmissions to determine which of the one or more wireless toy characters are located within the second scaled room.

6. The wireless interactive doll-house of claim 1, wherein the first scaled room includes a blinder to shield the first wireless receiver from stray wireless transmissions.

7. The wireless interactive doll-house of claim 6, wherein the blinder to further limit a reception area of the first wireless receiver within the first scaled room.

8. The wireless interactive doll-house of claim 1, wherein the first scaled room includes a blinder to limit a reception area of the first wireless receiver within the first scaled room.

9. The wireless interactive doll-house of claim 1, wherein the first wireless receiver includes a blinder to limit a reception area of the first wireless receiver within the first scaled room.

10. The wireless interactive doll-house of claim 1, wherein the first scaled room is open-faced to allow the one or more wireless characters to be moved within and without the first scaled room.

11. A wireless interactive playset, the playset comprising:

one or more wireless toy characters including a wireless transmitter to wirelessly transmit a character identifier in response to a trigger, a microcontroller coupled to the wireless transmitter, the microcontroller to generate the character identifier in response to the trigger, and a battery coupled to the microcontroller and the wireless transmitter, the battery to provide power to the microcontroller and the wireless transmitter;

and a toy structure to receive the character identifier from each respective one or more wireless toy characters located within the toy structure, the toy structure including one or more wireless receivers to receive wireless signals from the one or more wireless toy characters located within the toy structure and to form received character identifiers, a processor coupled to the one or more wireless receivers, the processor to execute a program in response to receiving a received character identifier and to generate electrical signals responsive thereto, a loudspeaker coupled to the processor to receive the electrical signals, the loudspeaker to transduce the electrical signals from the processor into audio sound, and a power supply to couple to the processor and the one or more wireless receivers to provide power thereto.

12. The wireless interactive playset of claim 11, wherein the one or more wireless toy characters further include a switch to generate the trigger for the microcontroller to generate the character identifier and for the wireless transmitter to wirelessly transmit the character identifier.

13. The wireless interactive playset of claim 12, wherein the switch is a manual switch selected by a user.

14. The wireless interactive playset of claim 12, wherein the switch is a jiggle switch selected by motion of the one or more wireless toy characters.

15. The wireless interactive playset of claim 11, wherein the one or more wireless toy characters are infrared toy characters, the wireless transmissions are infrared wireless transmissions, and the one or more wireless receivers are infrared detectors.

16. The wireless interactive playset of claim 11, wherein the toy structure further includes a first switch coupled to the processor, the first switch to toggle the processor between an automatic scan mode and a manual scan mode; and a second switch coupled to the processor, the second switch to manually trigger the processor to scan the toy structure for the one or more wireless toy characters.

17. The wireless interactive playset of claim 16, wherein the toy structure further includes a third switch coupled to the processor, the third switch to alter the amplitude of the electrical signals provided to the loudspeaker and volume level of the audio signals.

18. The wireless interactive playset of claim 17, wherein the toy structure further includes a fourth switch coupled between the power supply and the processor and the one or more wireless receivers, the fourth switch to switch power on and off to the processor and the one or more wireless receivers.

19. The wireless interactive playset of claim 11, wherein the toy structure further includes a processor selectable switch having a control terminal coupled to the processor and a pair of switch terminals coupled between the power supply and the one or more wireless receivers, the processor selectable switch to switch power on and off to the one or more wireless receivers in response to a signal from the processor at the control terminal.

20. The wireless interactive playset of claim 11, wherein the toy structure is a doll-house, and the one or more wireless toy characters are objects or dolls for the doll-house.

21. The wireless interactive playset of claim 20, wherein the doll-house is a clam shell design have a first doll-house half and a second doll-house half rotatably joined together at one end by one or more hinges.

22. The wireless interactive playset of claim 20, wherein the doll-house includes scaled toy rooms with scaled toy doors, scaled toy windows, and scaled toy walls.

23. The wireless interactive playset of claim 20, wherein the wireless toy objects include pets, furniture, or a non-animate object.

24. An infrared toy character to interface with an infrared toy structure, the infrared toy character comprising:

an infrared transmitter to wirelessly transmit a character identifier in response to a trigger, the infrared transmitter to wirelessly transmit the character identifier using infrared signals;

a microcontroller coupled to the infrared transmitter, the microcontroller to generate the character identifier in response to the trigger;

a battery coupled to the microcontroller and the infrared transmitter, the battery to provide power to the microcontroller and the infrared transmitter; and a housing to physically hold the infrared transmitter, the microcontroller, and the battery together as a unit.

25. The infrared toy character of claim 24, wherein the housing is opaque to visible wavelengths of light to conceal the infrared transmitter, the microcontroller, and the battery from view, and the housing is transparent to infrared wavelengths of light to allow infrared signals to pass through.

26. The infrared toy character of claim 24, wherein the housing is opaque to conceal the infrared transmitter, the microcontroller, and the battery from view, and the housing includes an opening to allow an emitter end of the infrared transmitter to be mounted therein to transmit infrared signals out from the infrared toy character.

27. The infrared toy character of claim 24, further comprising:

a switch to generate the trigger for the microcontroller to generate the character identifier and for the infrared transmitter to wirelessly transmit the character identifier.

28. The infrared toy character of claim 27, wherein the switch is a manual switch selectable by a user.

29. The infrared toy character of claim 27, wherein the switch is a jiggle switch selectable by motion of the infrared toy character.

30. The infrared toy character of claim 24, wherein the microcontroller is programmable to generate differing character identifiers between each of a plurality of infrared toy characters.

31. The infrared toy character of claim 24, wherein the microcontroller is programmable to repeat the generation of the character identifier at differing repetition rates and the wireless transmission is at the differing repetition rates.

32. The infrared toy character of claim 31, wherein the program for character identifier generation in each microcontroller of a plurality of infrared toy characters has a unique repetition rate differing from all others so that an overlap in infrared transmissions by the plurality of infrared toy characters may be avoided.

33. The infrared toy character of claim 24, wherein the character identifier includes a header, a character identification number, and a device number.

34. The infrared toy character of claim 24, wherein the character identifier is wirelessly transmitted in a carrier signal frequency modulated by a serial data bit stream of the character identifier.

35. A method for a wireless toy playset, the method comprising:

scanning in parallel one or more rooms of a wireless interactive toy structure for one or more wireless transmissions from one or more wireless toy characters;

detecting one or more wireless transmissions associated with at least one of the one or more rooms of the wireless interactive toy structure;

validating at least one of the one or more wireless transmissions in the at least one of the one or more rooms of the wireless interactive toy structure as a valid wireless transmission associated with the at least one of the one or more rooms of the wireless interactive toy structure from at least one of the one or more wireless toy characters;

obtaining a character identifier from the valid wireless transmission associated with the at least one of the one or more rooms of the wireless interactive toy structure from the at least one of the one or more wireless toy characters; and generating a programmed response in response to the character identifier and the at least one room of the one or more rooms of the wireless interactive toy structure associated with the valid wireless transmission.

36. The method of claim 35, further comprising:

prior to generating the programmed response, repeating the scanning, the detecting, the validating, and the obtaining of the character identifier to provide error detection/correction, and if the character identifier continues to be associated with the same at least one of the one or more rooms of the wireless interactive toy structure, then performing the generating of the programmed response.

37. The method of claim 35, wherein, the scanning, the detecting, the validating, the obtaining, and the generating is automatically triggered periodically by a processor.

38. The method of claim 35, wherein, the scanning, the detecting, the validating, the obtaining, and the generating is manually triggered by a user.

39. The method of claim 35, wherein, the programmed response is the generation of audible sound to simulate a dialogue between a plurality of wireless toy characters.

40. The method of claim 35, wherein, the one or more wireless transmissions from the one or more wireless toy characters is manually triggered by a user.

41. The method of claim 35, wherein, the one or more wireless transmissions from the one or more wireless toy characters is triggered by movement thereof.

42. The method of claim 35, wherein the wireless interactive toy structure is an infrared interactive toy structure, the one or more wireless toy characters are infrared toy characters, and the one or more wireless transmissions are infrared wireless transmissions.

43. The method of claim 42, wherein the infrared interactive toy structure is a doll-house, and the one or more infrared toy characters are objects or dolls for the doll-house.

44. The method of claim 35, wherein, the programmed response is the generation of a visual effect, a sound effect or a motion effect.

* * * * *